US009763523B2

(12) United States Patent
Thomson et al.

(10) Patent No.: US 9,763,523 B2
(45) Date of Patent: Sep. 19, 2017

(54) BASSINET SUPPORT

(71) Applicant: KIDS II, INC., Atlanta, GA (US)

(72) Inventors: John M. Thomson, Johns Creek, GA (US); Stephen R. Burns, Cumming, GA (US); Joseph W. Staley, Atlanta, GA (US); Chaitanya Tadipatri, Alpharetta, GA (US); Frank Chih-Feng Chen, Shenzhen (CN); Mark Mendes, Loganville, GA (US)

(73) Assignee: KIDS II, INC., Atlanta, GA (US)

( * ) Notice: Subject to any disclaimer, the term of this patent is extended or adjusted under 35 U.S.C. 154(b) by 377 days.

(21) Appl. No.: 14/021,934

(22) Filed: Sep. 9, 2013

(65) Prior Publication Data

US 2014/0068856 A1 Mar. 13, 2014

Related U.S. Application Data

(60) Provisional application No. 61/698,951, filed on Sep. 10, 2012, provisional application No. 61/817,472, filed on Apr. 30, 2013, provisional application No. 61/840,861, filed on Jun. 28, 2013, provisional application No. 61/846,241, filed on Jul. 15, 2013.

(51) Int. Cl.

| | |
|---|---|
| ***A47D 7/00*** | (2006.01) |
| ***A47D 7/03*** | (2006.01) |
| ***A47D 13/06*** | (2006.01) |
| ***A47D 15/00*** | (2006.01) |

(52) U.S. Cl.

CPC ..... *A47D 7/00* (2013.01); *A47D 7/005* (2013.01); *A47D 7/03* (2013.01); *A47D 13/063* (2013.01); *A47D 13/066* (2013.01); *A47D 15/003* (2013.01)

(58) Field of Classification Search

CPC ..... A47D 5/00; A47D 5/006; A47D 7/00; A47D 7/002; A47D 7/005; A47D 7/01; A47D 7/03; A47D 7/04; A47D 9/00; A47D 9/005; A47D 13/00; A47D 13/06; A47D 13/061; A47D 13/063; A47D 13/066

USPC ..... 5/93.1, 93.2, 95, 97, 98.1, 98.3, 99, 655

See application file for complete search history.

(56) References Cited

U.S. PATENT DOCUMENTS

| | | | |
|---|---|---|---|
| 548,901 | A | 10/1895 | Welch |
| 1,183,819 | A | 5/1916 | Keiser |
| 1,374,333 | A | 4/1921 | Stotler |

(Continued)

FOREIGN PATENT DOCUMENTS

| | | | |
|---|---|---|---|
| AU | 715883 | B3 | 2/2000 |
| GB | 1360375 | A | 7/1974 |

OTHER PUBLICATIONS

Keder—An Education on it's Design & Use; J & J Carter Limited; 2013; 6 pgs.

*Primary Examiner* — Robert G Santos
(74) *Attorney, Agent, or Firm* — Gardner Groff Greenwald & Villanueva, PC

(57) ABSTRACT

A child containment device and a mattress support assembly for a child containment device providing a generally flat mattress configuration under load of a child supported thereon; a multi-paneled mattress for a child containment device allowing repositioning of mattress panels between an expanded state and a compact state, and wherein in the expanded state, structural couplings maintain the mattress in a generally flat configuration; and a chamfered corner arrangement for resisting curling of a mattress for a child containment device.

19 Claims, 24 Drawing Sheets

(56) References Cited

U.S. PATENT DOCUMENTS

| | | | | |
|---|---|---|---|---|
| 2,287,907 | A | 6/1942 | Schettler, Jr. | |
| 2,423,402 | A | 7/1947 | Olsen | |
| 2,590,315 | A | 3/1952 | Hawley, Jr. | |
| 2,659,903 | A | 11/1953 | Hagelfldt | |
| 2,784,420 | A | 3/1957 | Moltane | |
| 2,790,978 | A | 5/1957 | Tigrett | |
| 2,948,287 | A | 8/1960 | Rupert | |
| 3,223,098 | A | 12/1965 | Dole, Jr. | |
| 3,273,862 | A | 9/1966 | Miller | |
| 3,658,025 | A | 4/1972 | Hood et al. | |
| 3,875,623 | A | 4/1975 | Johnston | |
| 3,924,280 | A | 12/1975 | Vaiano | |
| 4,018,260 | A | 4/1977 | Baslow | |
| 4,105,244 | A | 8/1978 | Colby | |
| 4,848,843 | A | 7/1989 | Gibbs | |
| 4,921,369 | A | 5/1990 | Chew, II et al. | |
| 5,349,709 | A | 9/1994 | Cheng | |
| 5,473,785 | A | 12/1995 | Lager et al. | |
| 5,555,577 | A | 9/1996 | Volpe | |
| 5,613,543 | A | 3/1997 | Walton | |
| 5,845,349 | A | 12/1998 | Tharalson et al. | |
| 5,911,478 | A | 6/1999 | Goodman | |
| 5,992,348 | A | 11/1999 | Harding | |
| 6,004,182 | A | 12/1999 | Pasin | |
| 6,076,448 | A | 6/2000 | Rexroad | |
| 6,098,217 | A | 8/2000 | Hammil | |
| 6,131,218 | A * | 10/2000 | Wang | A47D 13/06 5/93.1 |
| 6,148,456 | A | 11/2000 | Tharalson et al. | |
| 6,158,067 | A | 12/2000 | Cheng | |
| 6,233,759 | B1 | 5/2001 | Warner, Jr. et al. | |
| 6,293,624 | B1 | 9/2001 | Gaylord et al. | |
| 6,301,731 | B1 | 10/2001 | Jakubowski et al. | |
| 6,370,714 | B1 | 4/2002 | Elzenbeck | |
| 6,402,116 | B1 | 6/2002 | Northup | |
| 6,434,767 | B1 | 8/2002 | Welsh, Jr. | |
| 6,510,570 | B2 | 1/2003 | Hartenstine et al. | |
| 6,511,562 | B1 | 1/2003 | Coffield | |
| 6,560,795 | B2 | 5/2003 | Hsia | |
| 6,560,827 | B1 | 5/2003 | Gross | |
| 6,574,812 | B2 | 6/2003 | Jakubowski et al. | |
| 6,578,211 | B2 | 6/2003 | Tharalson et al. | |
| 6,585,323 | B2 | 7/2003 | Gaylord et al. | |
| 6,623,079 | B2 | 9/2003 | Gregory | |
| 6,779,849 | B1 | 8/2004 | Harper et al. | |
| 6,877,173 | B2 | 4/2005 | Tharalson et al. | |
| 6,901,613 | B1 | 6/2005 | Hsia | |
| 6,931,677 | B2 | 8/2005 | Tharalson et al. | |
| 6,954,949 | B1 | 10/2005 | Chen | |
| 7,003,821 | B2 | 2/2006 | DeHart et al. | |
| 7,013,505 | B2 | 3/2006 | Martin | |
| 7,017,203 | B2 | 3/2006 | Chen | |
| RE39,136 | E | 6/2006 | Tharalson et al. | |
| 7,063,096 | B2 | 6/2006 | Stoeckler | |
| 7,404,219 | B2 | 7/2008 | Berkey | |
| 7,415,739 | B2 | 8/2008 | Tharalson et al. | |
| 7,543,342 | B2 | 6/2009 | Zhao et al. | |
| 7,568,242 | B2 | 8/2009 | Troutman | |
| 7,739,759 | B2 | 6/2010 | Mendes et al. | |
| 7,752,693 | B2 | 7/2010 | Espenshade | |
| 7,882,579 | B2 | 2/2011 | Jackson et al. | |
| 8,141,186 | B2 | 3/2012 | Burns et al. | |
| 8,201,291 | B2 | 6/2012 | Burns et al. | |
| 8,424,131 | B2 | 4/2013 | Thomsen et al. | |
| 8,528,130 | B2 | 9/2013 | Bu et al. | |
| 8,566,988 | B2 | 10/2013 | Son et al. | |
| 9,113,723 | B2 * | 8/2015 | Greger | A47D 9/00 |
| 2002/0092094 | A1 * | 7/2002 | Welsh, Jr. | A47D 7/04 5/95 |
| 2002/0152550 | A1 * | 10/2002 | Tharalson | A47D 5/00 5/95 |
| 2003/0196264 | A1 * | 10/2003 | Tharalson | A47D 5/00 5/95 |
| 2005/0273928 | A1 * | 12/2005 | Tharalson | A47D 5/00 5/95 |
| 2006/0000019 | A1 | 1/2006 | Martin | |
| 2007/0271697 | A1 | 11/2007 | Martin | |
| 2008/0010742 | A1 * | 1/2008 | Tharalson | A47D 5/00 5/95 |
| 2009/0077742 | A1 | 3/2009 | Burns et al. | |
| 2011/0283457 | A1 * | 11/2011 | Son | A47D 9/00 5/690 |
| 2012/0216346 | A1 | 8/2012 | Rampton et al. | |
| 2012/0233770 | A1 | 9/2012 | Greger et al. | |
| 2013/0117930 | A1 * | 5/2013 | Hsu | A47D 13/063 5/93.1 |
| 2014/0068856 | A1 * | 3/2014 | Thomson | A47D 7/00 5/93.1 |
| 2014/0165288 | A1 * | 6/2014 | Wang | A47D 9/005 5/99.1 |
| 2014/0208505 | A1 * | 7/2014 | Burkholder | A47D 13/063 5/99.1 |

* cited by examiner

BASSINET SUPPORT

CROSS-REFERENCE TO RELATED APPLICATIONS

This application claims the benefit of U.S. Provisional Patent Application Ser. No. 61/698,951 filed Sep. 10, 2012, U.S. Provisional Patent Application Ser. No. 61/817,472 filed Apr. 30, 2013, U.S. Provisional Patent Application Ser. No. 61/840,861 filed Jun. 28, 2013, and U.S. Provisional Patent Application Ser. No. 61/846,241 filed Jul. 15, 2013, the entireties of which are hereby incorporated by reference herein.

TECHNICAL FIELD

The present invention relates generally to the field of infant and childrens' products, and more particularly to a child containment device having an improved mattress and mattress support assembly.

BACKGROUND

Child containment devices such as play yards, play pens, bassinets, cribs, sleepers, cradles, and the like are commonly used to provide a safe and comfortable area for infants and small children to play and rest. Such devices generally include a horizontal floor and vertical walls, and may include a foldable frame structure and fabric panels extending between the frame elements for portability and ease of use.

Continuing improvements are sought in the field of children's products, for example for improved comfort, convenience, safety, and/or performance. Accordingly, it is to the provision of improved child containment systems, and to improved mattress support assemblies for such systems, meeting these and other needs that the present invention is primarily directed.

SUMMARY

In example embodiments, the present invention provides an improved child containment device, such as a play yard, play pen, bassinet, crib, sleeper, cradle, and the like, and/or an improved mattress support assembly for a child containment device. A raised bassinet mattress may be provided in a child containment device for supporting the infant or child above the floor, for example for napping or diaper changing, and to position the child for easier access by a care-giver. Various support assemblies within the scope of the present invention may be incorporated to maintain structural support and flatness of a mattress, and to provide for improved comfort, convenience, safety, and/or performance to a child containment system with an elevated mattress support assembly.

In one aspect, the present invention relates to a support structure for a mattress within a child containment device, the child containment device comprising at least one wall. The support structure preferably includes a support panel having a periphery configured to align with at least a portion of the at least one wall of the child containment device. The support structure preferably also includes at least one retractable support member for engagement with the support panel to maintain the support panel in a generally flat configuration.

In another aspect, the invention relates to a mattress for a child containment device. The mattress preferably includes a plurality of mattress panels and structural couplings between two or more of the plurality of mattress panels, the structural couplings allowing repositioning of the plurality of mattress panels between an expanded state and a compact state, and wherein in the expanded state, the structural couplings maintain the mattress in a generally flat configuration.

In still another aspect, the invention relates to a mattress for a child containment device, the mattress comprising at least two sides defining a corner therebetween, and further comprising a chamfered corner assembly at the corner for resisting curling.

In still another aspect, the invention relates to a child containment device. The child containment device preferably includes a mattress comprising a plurality of mattress panels and structural couplings between two or more of the plurality of mattress panels, the structural couplings allowing repositioning of the plurality of mattress panels between an expanded state and a compact state, and wherein in the expanded state, the structural couplings maintain the mattress in a generally flat configuration. The child containment device preferably also includes a support structure for supporting the mattress in its expanded state, the support structure comprising a support panel having a periphery configured to align with at least a portion of a wall of the child containment device, and at least one retractable support member for engagement with the support panel to maintain the support panel in a generally flat configuration.

These and other aspects, features and advantages of the invention will be understood with reference to the drawing figures and detailed description herein, and will be realized by means of the various elements and combinations particularly pointed out in the appended claims. It is to be understood that both the foregoing general description and the following brief description of the drawings and detailed description of the invention are exemplary and explanatory of preferred embodiments of the invention, and are not restrictive of the invention, as claimed.

DETAILED DESCRIPTION OF EXAMPLE EMBODIMENTS

The present invention may be understood more readily by reference to the following detailed description of the invention taken in connection with the accompanying drawing figures, which form a part of this disclosure. It is to be understood that this invention is not limited to the specific devices, methods, conditions or parameters described and/or shown herein, and that the terminology used herein is for the purpose of describing particular embodiments by way of example only and is not intended to be limiting of the claimed invention. Any and all patents and other publications identified in this specification are incorporated by reference as though fully set forth herein.

Also, as used in the specification including the appended claims, the singular forms "a," "an," and "the" include the plural, and reference to a particular numerical value includes at least that particular value, unless the context clearly dictates otherwise. Ranges may be expressed herein as from "about" or "approximately" one particular value and/or to "about" or "approximately" another particular value. When such a range is expressed, another embodiment includes from the one particular value and/or to the other particular value. Similarly, when values are expressed as approximations, by use of the antecedent "about," it will be understood that the particular value forms another embodiment.

Figure 1:
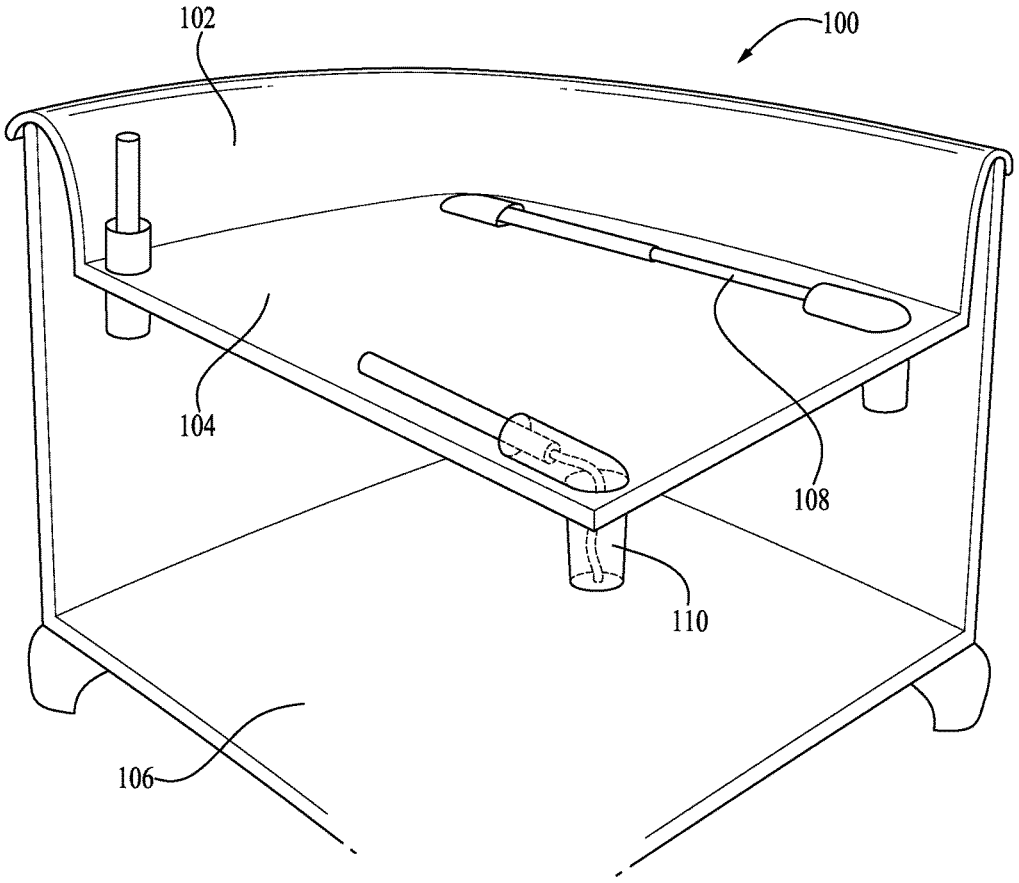
FIG. 1 is a perspective view of a child containment apparatus having a bassinet mattress support assembly according to an example embodiment of the invention.

With reference now to the drawing figures, wherein like reference numbers represent corresponding parts throughout the several views, FIG. 1 illustrates an example bassinet mattress support assembly 100, according to one embodiment of the present invention. As shown, the bassinet mattress support assembly 100 comprises a sidewall enclosure 102 coupled to a floor panel 104 and can be configured to be suspended within a play yard 106 or other child containment device. The floor panel 104 is generally rectangular, having a length that is longer than its width. At least one reinforcing rod 108 is coupled to the floor panel 104 and is selectively positionable in a functional configuration and a storage configuration. In the functional configuration, the reinforcing rods 108 lie on top of the floor panel 104 and are oriented parallel to the length of the floor panel. The rods 108 can provide support to a mattress (not shown) positioned on the floor panel 104. In the storage configuration, the reinforcing rods 108 are repositioned in a substantially vertical orientation perpendicular to the floor panel 104. The bassinet mattress support assembly 100 can include pockets 110 that retain the reinforcing rods 108 in the storage configuration, or other retaining means such as hook-and-loop fasteners, elastic loops, etc.

Figure 2:
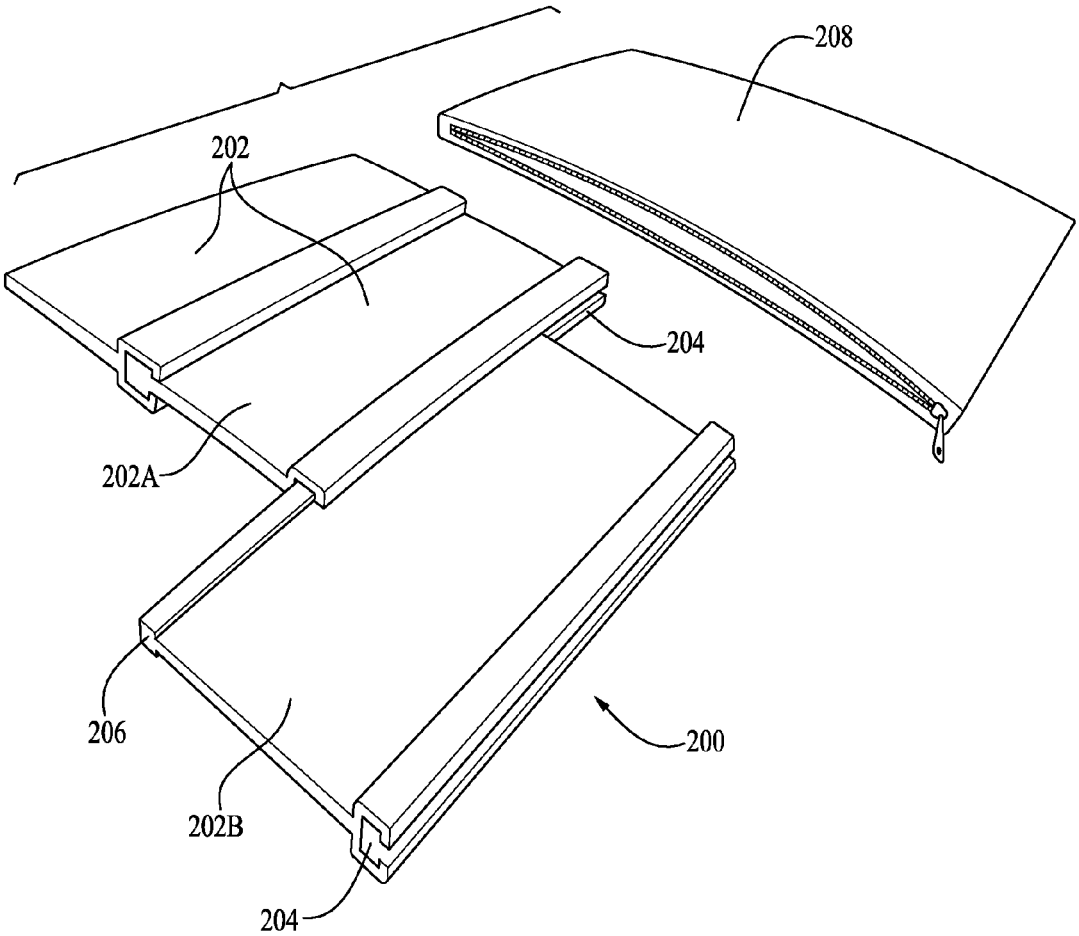
FIG. 2 is a perspective view of a bassinet mattress and support assembly for a child containment apparatus according to another example embodiment of the invention.

FIG. 2 illustrates an example bassinet mattress 200 for a child containment device, according to another embodiment of the present invention. The mattress 200 comprises a plurality of panels or boards 202 removably affixed to one another. A first board 202A includes a hollow channel 204 and a second board 202B includes an extrusion 206 that is configured to be removably received within the channel. For example, in the drawing figure, the channel 204 is a T-shaped channel and the corresponding extrusion 206 is a T-shaped extrusion. Locking interengagement of adjacent panels 202 by the cooperating engagement profiles, and the stiffening effect of the engagement profiles provides a substantially flat mattress assembly that resists sagging under the weight of a child placed on the mattress. The mattress 200 can be disposed within a liner 208 or cushioned pad or the boards 202 can include a cushioned layer to provide a comfortable support surface for a child. Cushioning inserts may be provided on the mattress panels or the liner between the engagement profiles to provide a smooth and continuous resting surface. In this manner, the panels 202 can be assembled for use as a mattress, and taken apart for more compact storage and transport.

Figure 3:
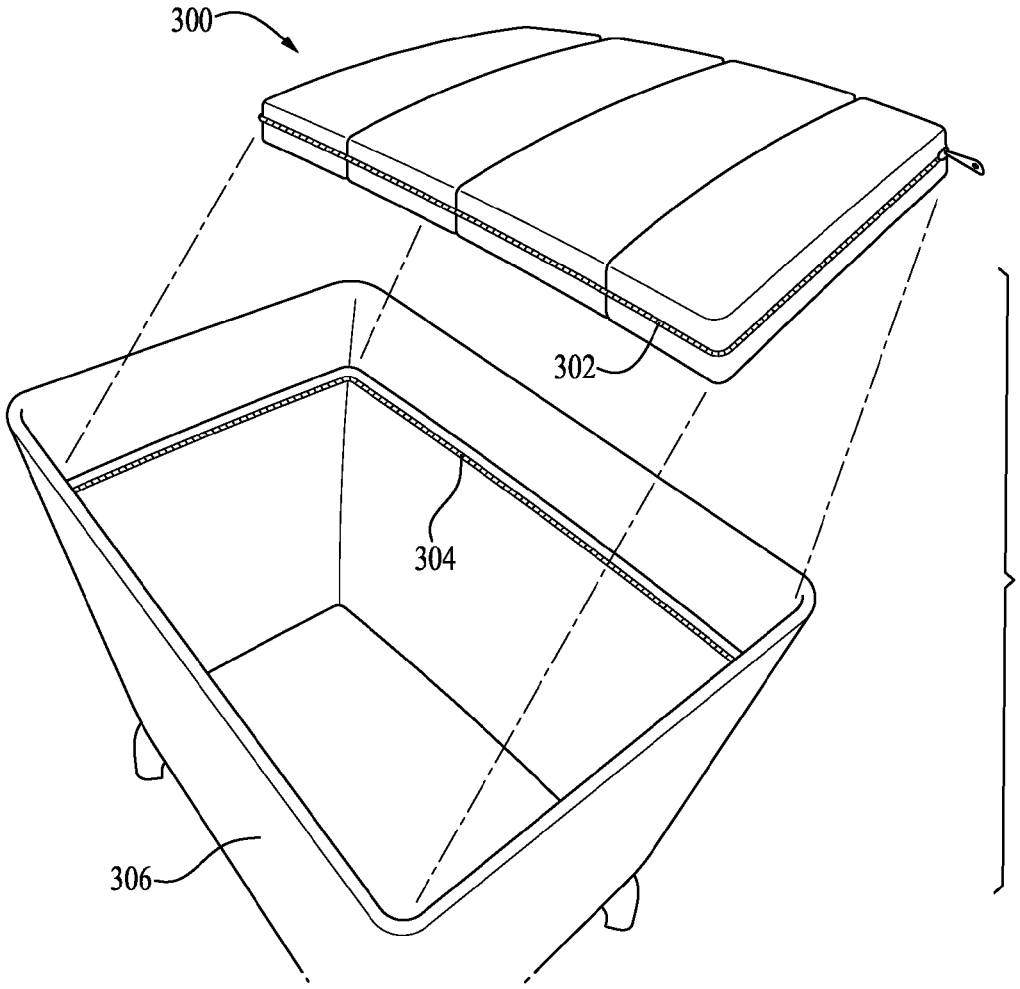
FIG. 3 is a perspective view of a bassinet mattress and support assembly for a child containment apparatus according to another example embodiment of the invention.

FIG. 3 illustrates a mattress 300 according to another example embodiment of the present invention. One or more fasteners 302 are positioned around the perimeter of the mattress 300. The fastener 302 is configured to removably mate with a corresponding mating fastener 304 located on a child support device, such as, for example, a play yard 306 or bassinet. For example, the fasteners 302 and 304 can be interengagable rows of zipper teeth that are fastened by zipping them together about the perimeter of the mattress. Alternative fasteners such as snaps, clips, buttons, hook-and-loop materials, and/or the like may be utilized instead of or in addition to the zipper.

Figure 4:
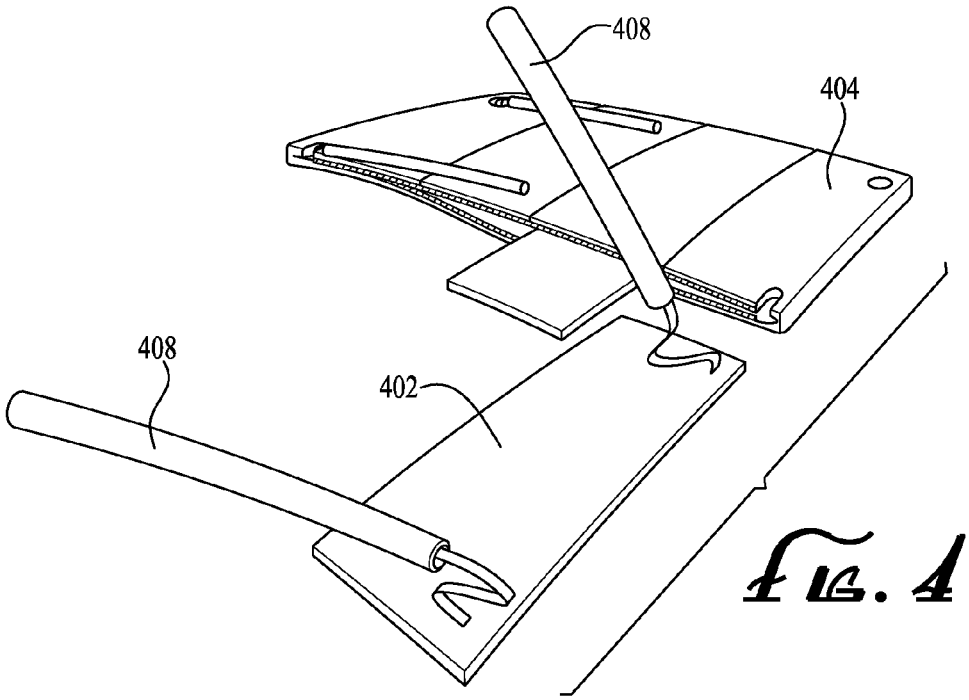
FIGS. 4 and 5 are perspective views of a bassinet mattress and support assembly for a child containment apparatus according to another example embodiment of the invention.
Figure 5:
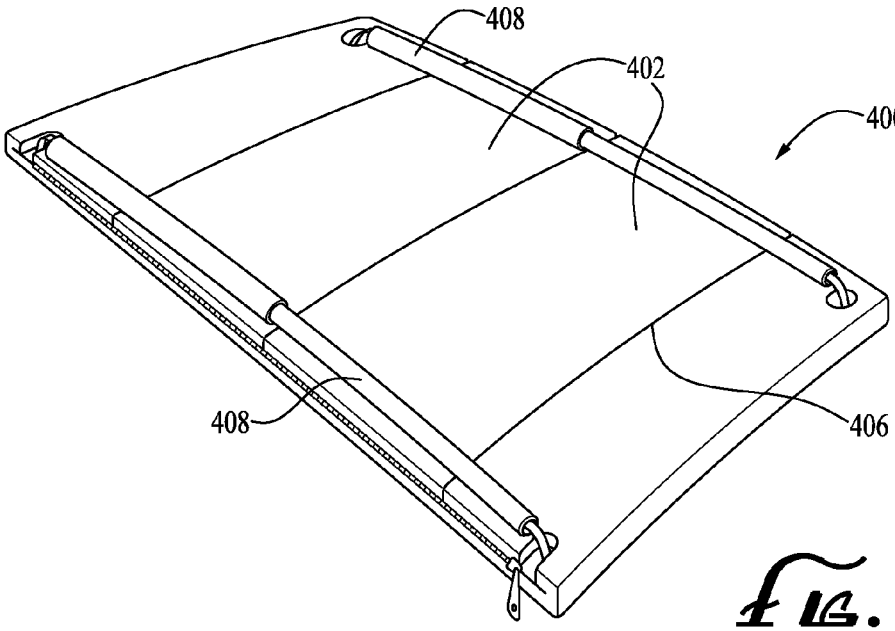

FIGS. 4 and 5 illustrate another example embodiment of a mattress 400, according to the present invention. The mattress 400 comprises a plurality of substantially rigid mattress panels or boards 402 hingedly coupled to one another and is convertible between an expanded configuration for use and a collapsed configuration for transport and storage. For example, the rigid boards 402 can be encased in a fabric sleeve 404 that includes seams 406 stitched between adjacent boards, which allow adjacent boards to pivot relative to one another. At least one reinforcing rod 408 is coupled to the at least one board 402 to support the boards in the expanded mattress configuration. In the depicted embodiment a pair of reinforcing rods are provided, one along each side of the mattress. Preferably, the reinforcing rods 408 are selectively positionable in a functional configuration, in which the reinforcing rods lie across a plurality of consecutive boards 402 to prohibit folding along the seams 406, and a storage configuration, wherein the mattress 400 can fold along the seams. Optionally, the reinforcing rods 408 can be telescoping or multiple rod segments can be configured to couple end to end, to allow for more compact storage when not in use.

Figure 6:
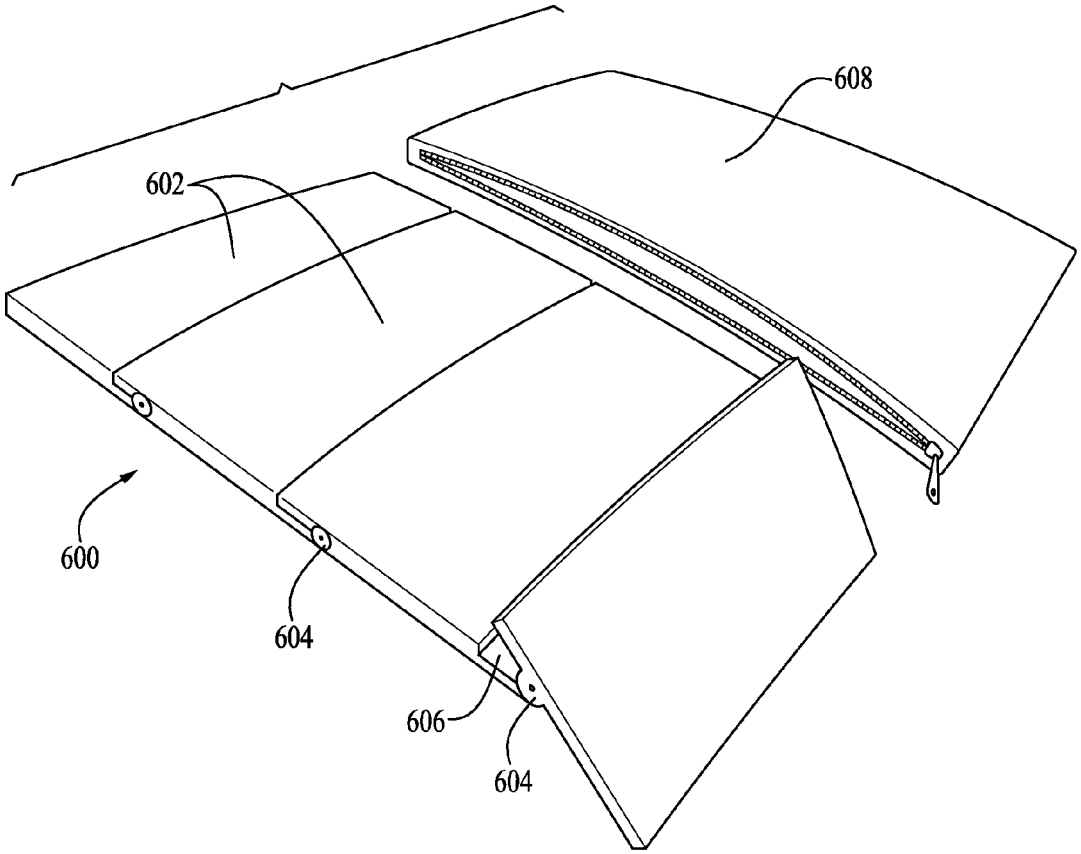
FIG. 6 is a perspective view of a bassinet mattress and support assembly for a child containment apparatus according to another example embodiment of the invention.

FIG. 6 illustrates another example embodiment of a mattress 600, according to the present invention. The mattress 600 comprises a plurality of substantially rigid mattress panels or boards 602 hingedly coupled to one another by one or more hinge mechanisms 604, such that the mattress is convertible between an expanded configuration and a collapsed configuration. The boards 602 can include integral stop surfaces 606 configured to interengage at the interface between adjacent boards to prevent the boards from rotating more than 180° with respect to one another in the expanded configuration of the mattress and maintain flatness (i.e., a generally planar configuration) of the mattress under the weight of a child placed thereon. The mattress 600 can be disposed within a liner 608 or the boards 602 can include a cushioned layer to provide a comfortable support surface for a child.

Figure 7:
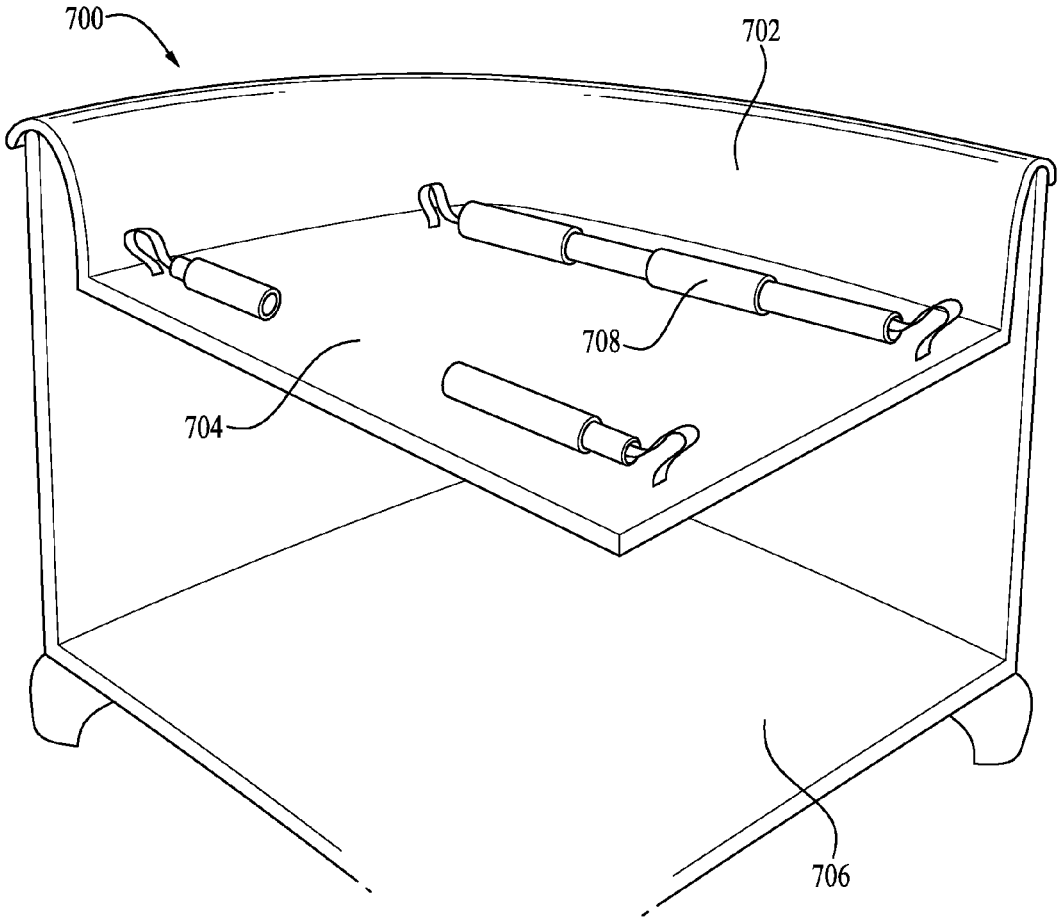
FIG. 7 is a perspective view of a bassinet mattress and support assembly for a child containment apparatus according to another example embodiment of the invention.

FIG. 7 illustrates another example embodiment of the bassinet 700, according to the present invention. As shown, the bassinet 700 comprises a sidewall enclosure 702 coupled to an elevated floor or support panel 704 and is configured to be suspended within a play yard 706 or other child containment device. At least one telescoping reinforcing rod 708 is coupled to the bassinet floor 704 and is selectively positionable between an extended configuration and a collapsed configuration. A mattress can be installed over the support panel or can be integrally formed therewith.

Figure 8:
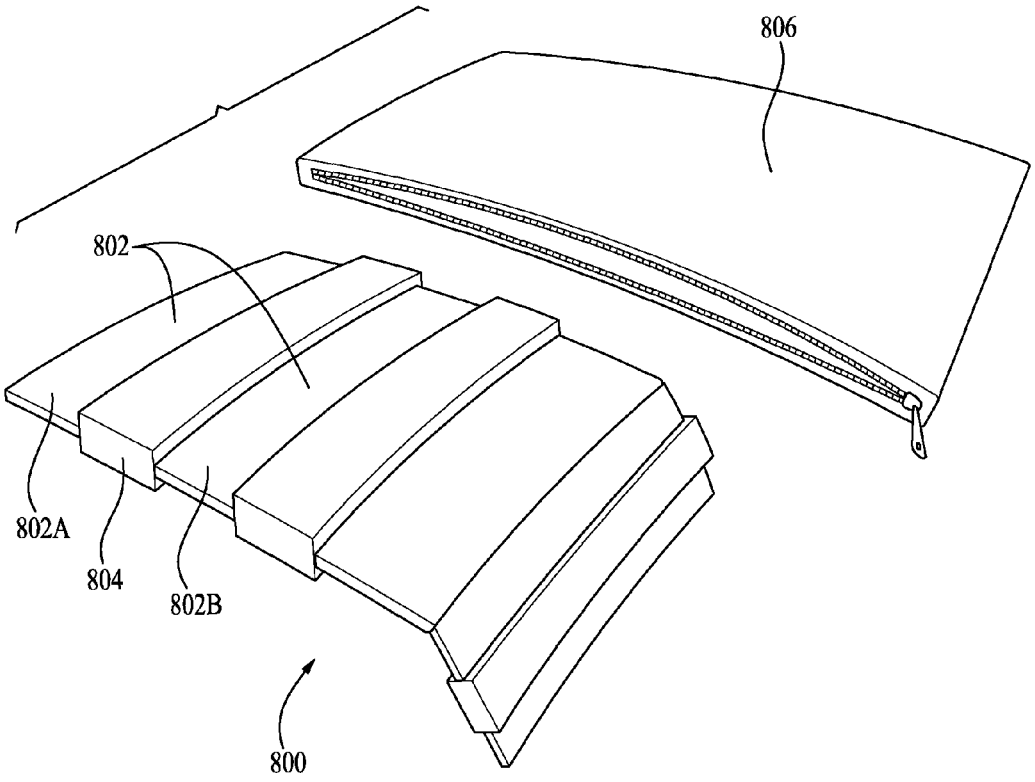
FIG. 8 is a perspective view of a bassinet mattress and support assembly for a child containment apparatus according to another example embodiment of the invention.

FIG. 8 illustrates yet another example embodiment of a mattress 800, according to the present invention. The mattress comprises a plurality of substantially rigid mattress panels or boards 802 removably affixed to one another. The panels of the mattress 800 can include one or more socket panels 804 configured to receive a portion of a first board 802A and a portion of a second board 802B in opposite sides thereof, in order to secure the first and second boards together. Alternatively, each board can include a male insertion profile on one side and a female receiver profile on the other side, so that boards can be assembled by interengagement of the respective profiles in a tongue-and-groove fashion into a substantially planar mattress assembly. The mattress 800 can be disposed within a liner 806 or the boards 802 can include a cushioned layer to provide a comfortable support surface for a child.

Figure 9:
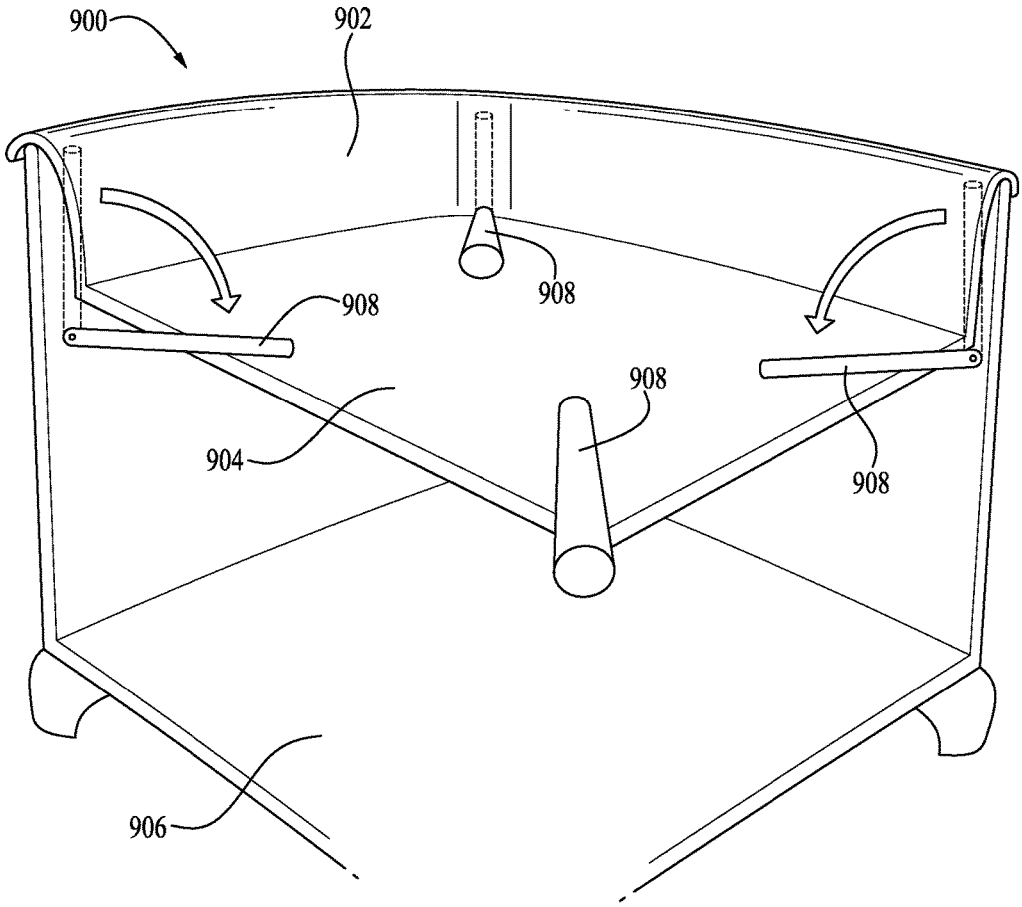
FIGS. 9 and 10 show perspective views of child containment devices having a bassinet mattress support assembly according to alternative example embodiments of the invention.
Figure 10:
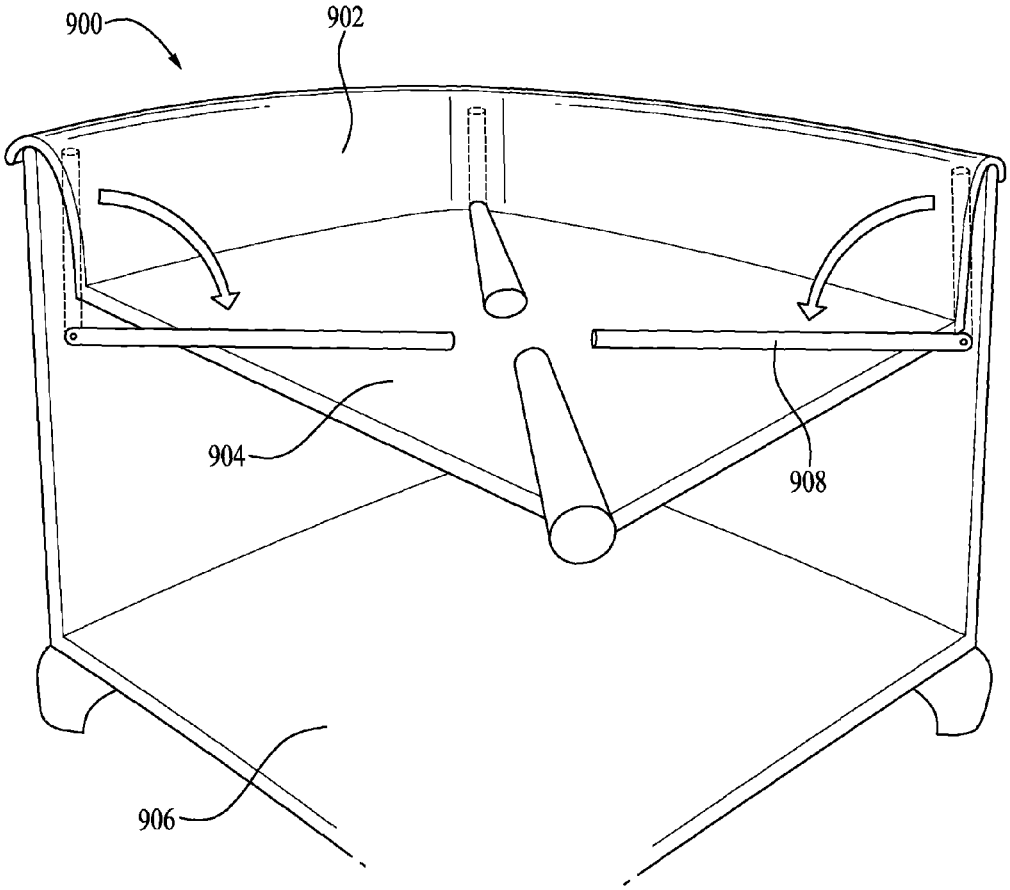

FIGS. 9 and 10 illustrate additional example embodiments of a bassinet 900, according to the present invention. The bassinet 900 comprises a sidewall enclosure 902 coupled to a floor panel 904 and is configured to be suspended within a play yard 906 or other child containment device. The bassinet 900 can include one or more reinforcing rods 908 configured to pivot between a functional configuration (solid lines), wherein the reinforcing rods lie diagonally across the floor panel 904 and can provide support to a mattress (not shown) positioned on the floor panel, and a storage configuration (broken lines), wherein the reinforcing rods are pivoted to a substantially vertical orientation perpendicular to the floor panel. In alternate embodiments, the reinforcing rods 908 can be configured to slide downward when pivoted to the storage configuration, so that the reinforcing rods do not extend above the upper perimeter of the play yard 906.

Figure 11:
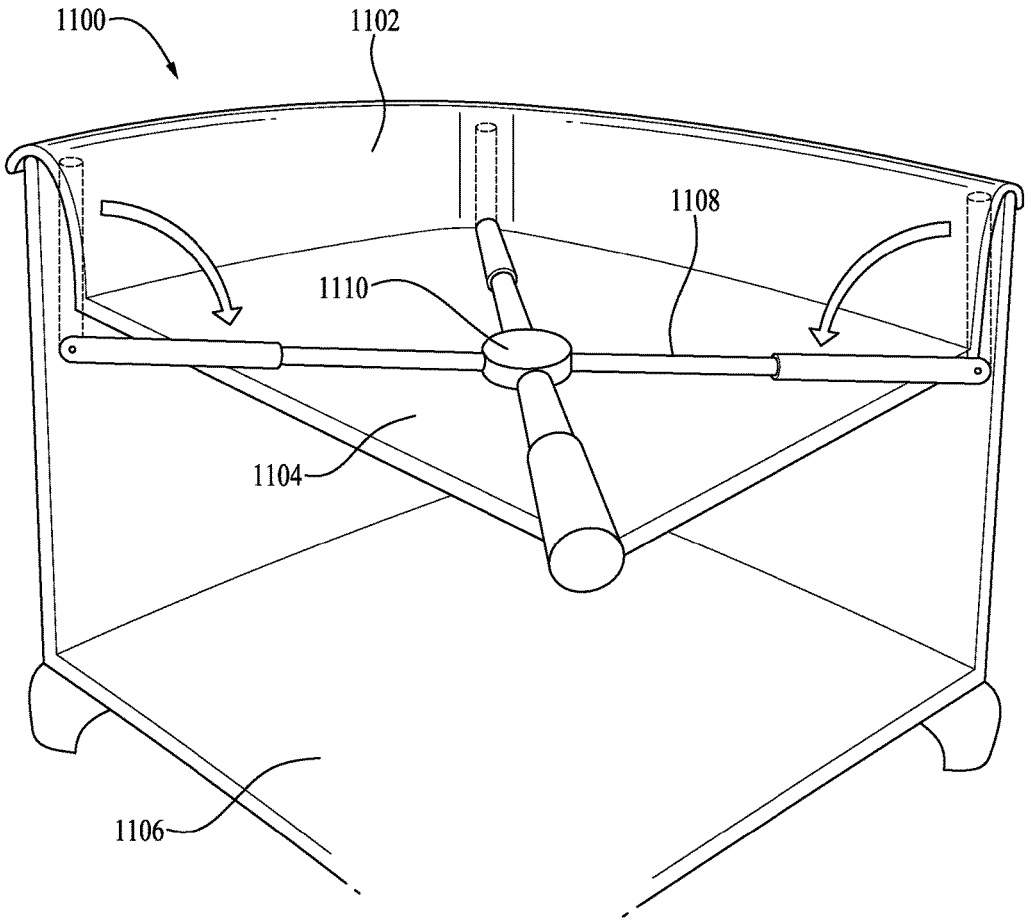
FIG. 11 is a perspective view of a child containment apparatus having a bassinet mattress support assembly according to another example embodiment of the invention.

FIG. 11 illustrates another example embodiment of a bassinet 1100, according to the present invention. The bassinet 1100 comprises a sidewall enclosure 1102 coupled to a floor panel 1104 and is configured to be suspended within a play yard 1106 or other child containment device. The bassinet 1100 can include one or more reinforcing rods 1108 configured to pivot between a functional configuration (solid lines), wherein the reinforcing rods lie diagonally across the floor panel 1104 and can provide support to a mattress (not shown) positioned on the floor panel, and a storage configuration (broken lines), wherein the reinforcing rods are pivoted to a substantially vertical orientation perpendicular to the floor panel. In this example embodiment, the bassinet 1100 also includes a central connection hub 1110 configured to releasably couple inner ends of the reinforcing rods 1108 together. Additionally, the reinforcing rods 1108 are optionally configured to telescope between an extended configuration and a collapsed configuration.

Figure 12:
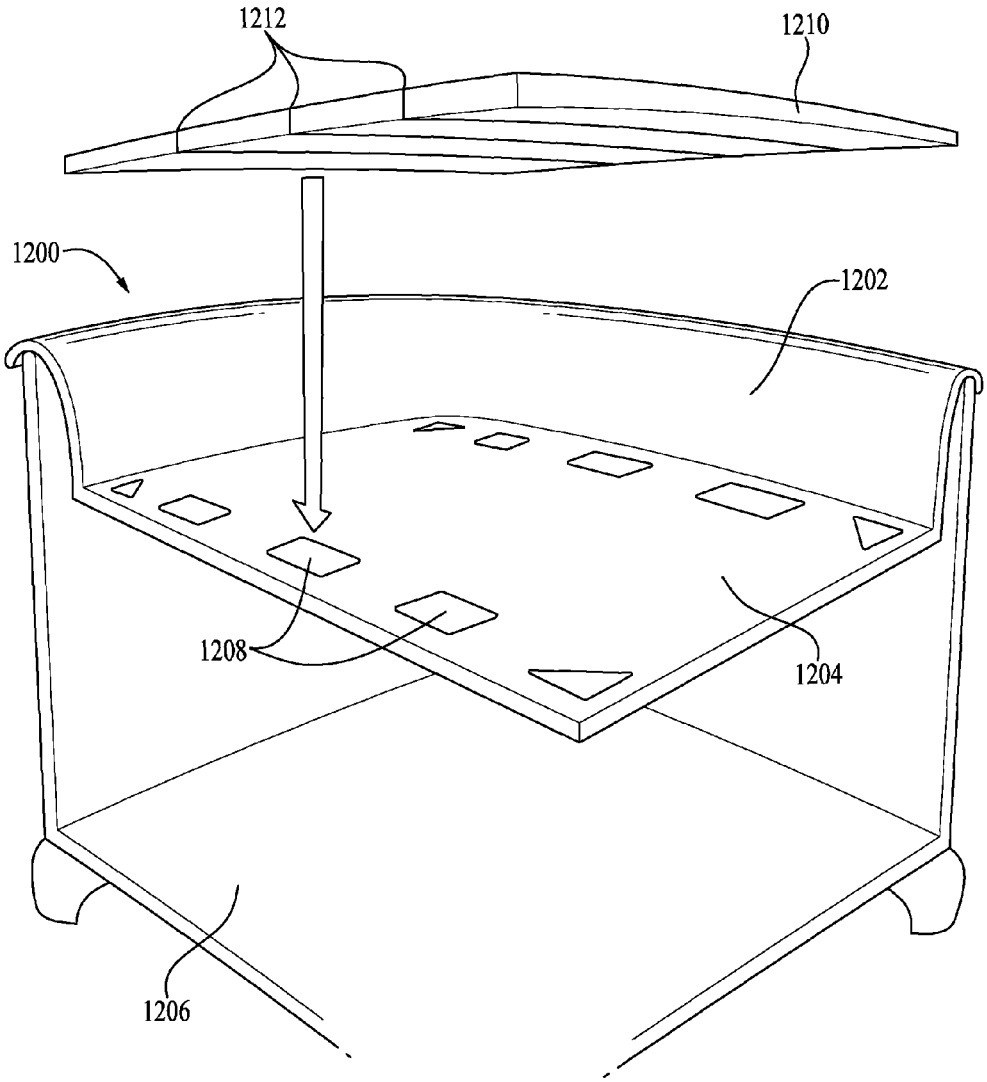
FIG. 12 is a perspective view of a child containment apparatus having a bassinet mattress support assembly according to another example embodiment of the invention.

FIG. 12 illustrates another example embodiment of the bassinet 1200 of the present invention. The bassinet 1200 comprises a sidewall enclosure 1202 coupled to a floor panel 1204 and is configured to be suspended within a play yard 1206 or other child containment device. One or more substantially rigid plates 1208 are secured to the floor panel 1204 and are configured to provide support to a mattress 1210 when the mattress is positioned atop the floor panel. The plates 1208 can be positioned adjacent to hinge points 1212 on the mattress 1210 to prevent the mattress from bending at the hinge points.

Figure 13:
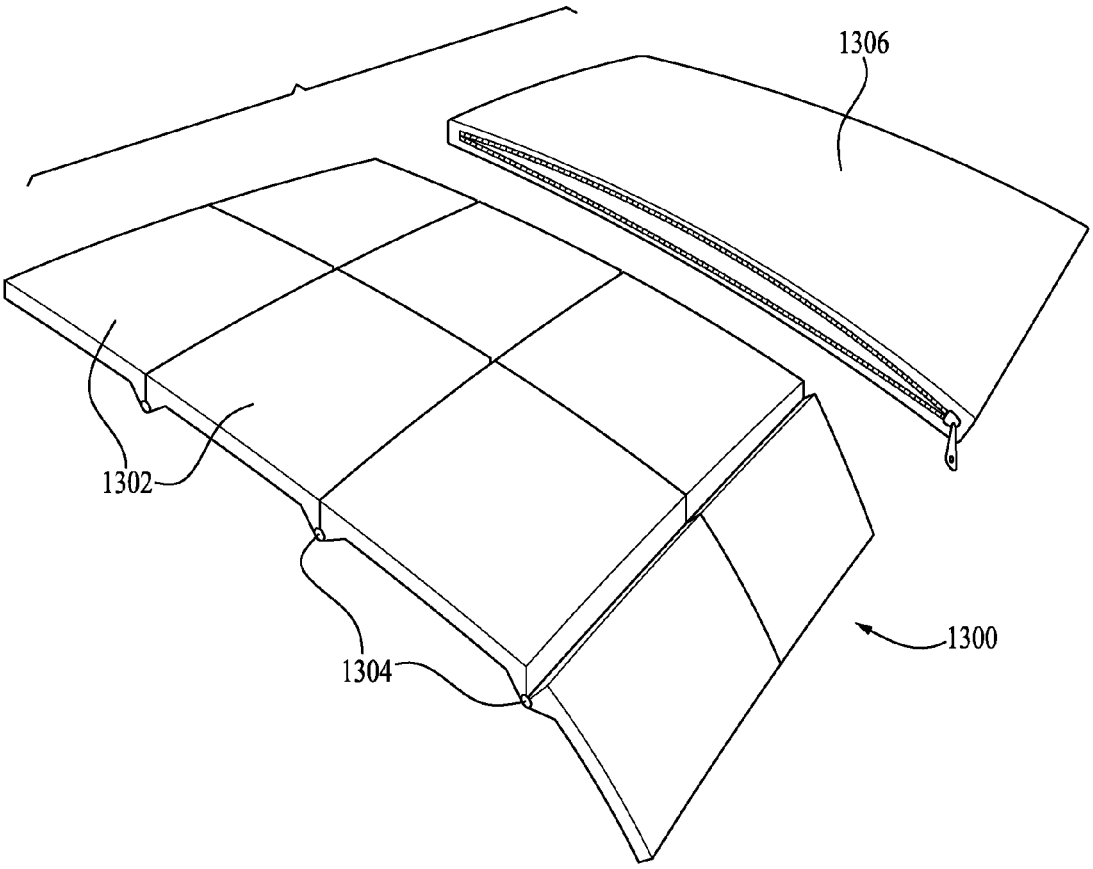
FIG. 13 is a perspective view of a bassinet mattress and support assembly for a child containment apparatus according to another example embodiment of the invention.

FIG. 13 illustrates another example embodiment of a mattress 1300, according to the present invention. The mattress 1300 comprises a plurality of substantially rigid boards 1302 hingedly coupled to each other by one or more hinge mechanisms 1304, such that the mattress is convertible between an expanded configuration and a collapsed configuration. The mattress 1300 is preferably configured with abutment faces at confronting ends of the boards such that adjacent boards 1302 cannot rotate more than 180° with respect to one another. In this manner, the mattress is self-supporting and maintains a substantially flat profile in its expanded state (hinged open) under load of a child supported thereon, and can be folded into a compact configuration for storage and transport. The mattress 1300 can be disposed within a liner 1306 or the boards 1302 can include a cushioned layer to provide a comfortable support surface for a child.

Figure 14A:
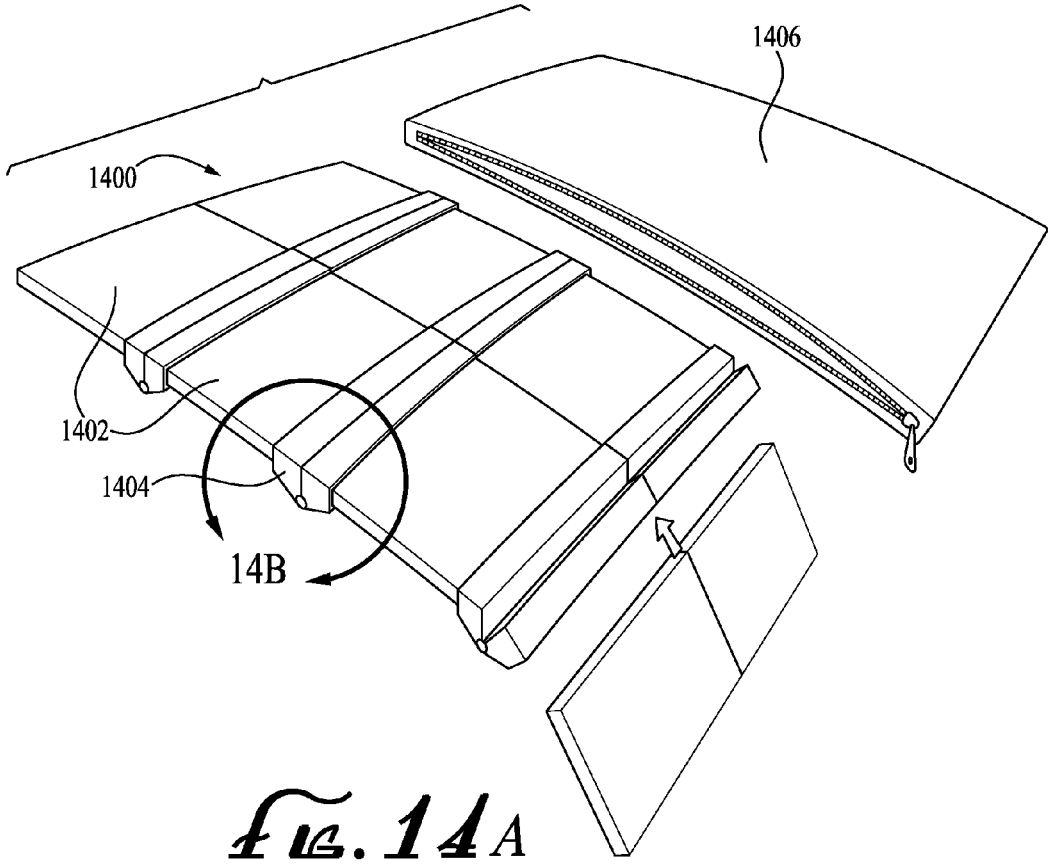
FIGS. 14A and 14B are a perspective view and a partial detail view of a bassinet mattress and support assembly for a child containment apparatus according to another example embodiment of the invention.
Figure 14B:
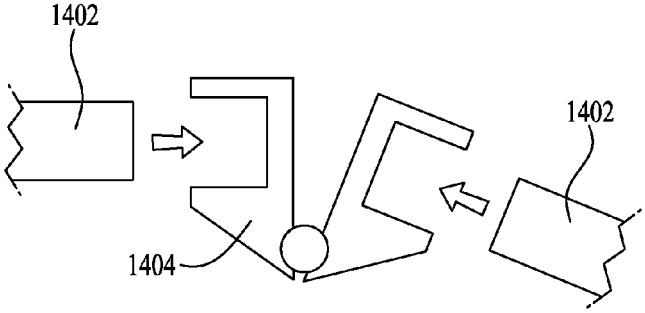

FIG. 14A illustrates another example embodiment of a mattress 1400, according to the present invention. The mattress 1400 comprises a plurality of substantially rigid panels or boards 1402 hingedly coupled to each other by one or more hinge mechanisms 1404 (shown in greater detail in FIG. 14B), such that the mattress is convertible between an expanded configuration and a collapsed configuration. The mattress 1400 is preferably configured such that adjacent boards 1402 cannot rotate more than 180° with respect to one another. The mattress 1400 can be disposed within a liner 1406 or the boards 1402 can include a cushioned layer to provide a comfortable support surface for a child.

Figure 15A:
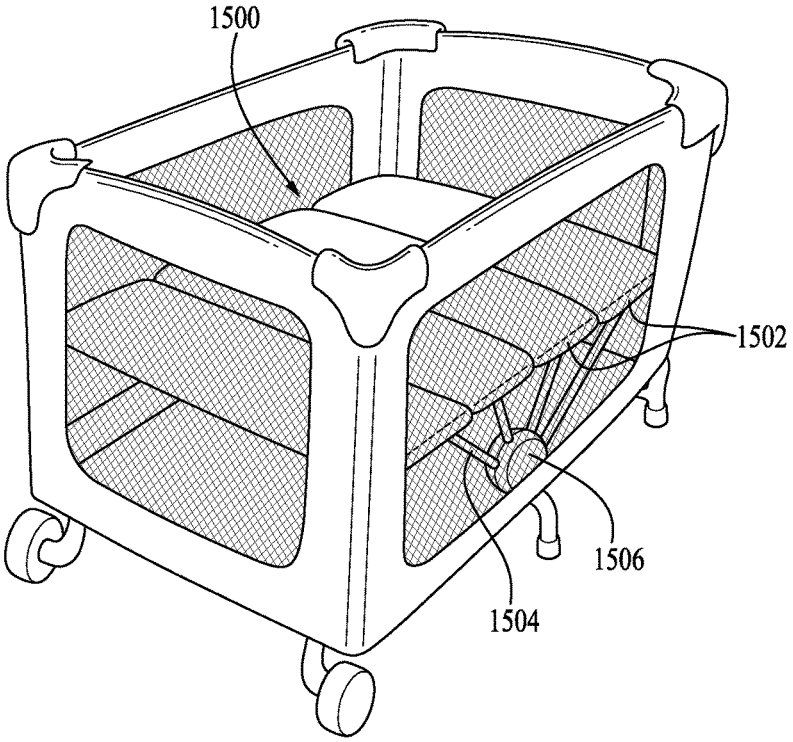
FIGS. 15A, 15B and 15C show a perspective view and side views showing a sequence of operation of a child containment apparatus having a bassinet mattress support assembly according to another example embodiment of the invention.
Figure 15B:
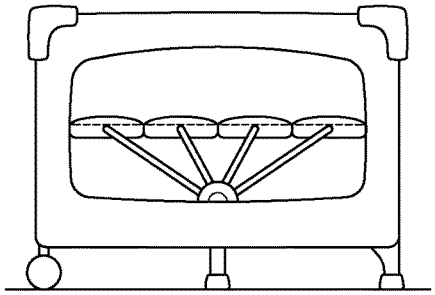
Figure 15C:
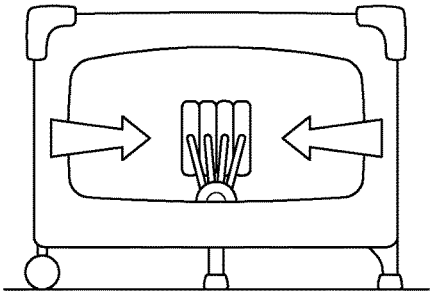

FIGS. 15A-15C illustrate another example embodiment of a mattress 1500, according to the present invention. The mattress 1500 comprises a plurality of substantially rigid panels or boards 1502 and is convertible between an expanded configuration and a collapsed configuration. Each board 1502 includes a support rod 1504 that is pivotally connected to a central hub 1506. In the expanded configuration, the rods 1504 fan or pivot outwardly, fanning out the boards 1502 to form a substantially flat, horizontal mattress 1500 that can support a child. In the collapsed configuration, the rods 1504 pivot inward, folding the boards 1502 up into a vertical or otherwise more compact configuration for storage or travel.

Figure 16A:
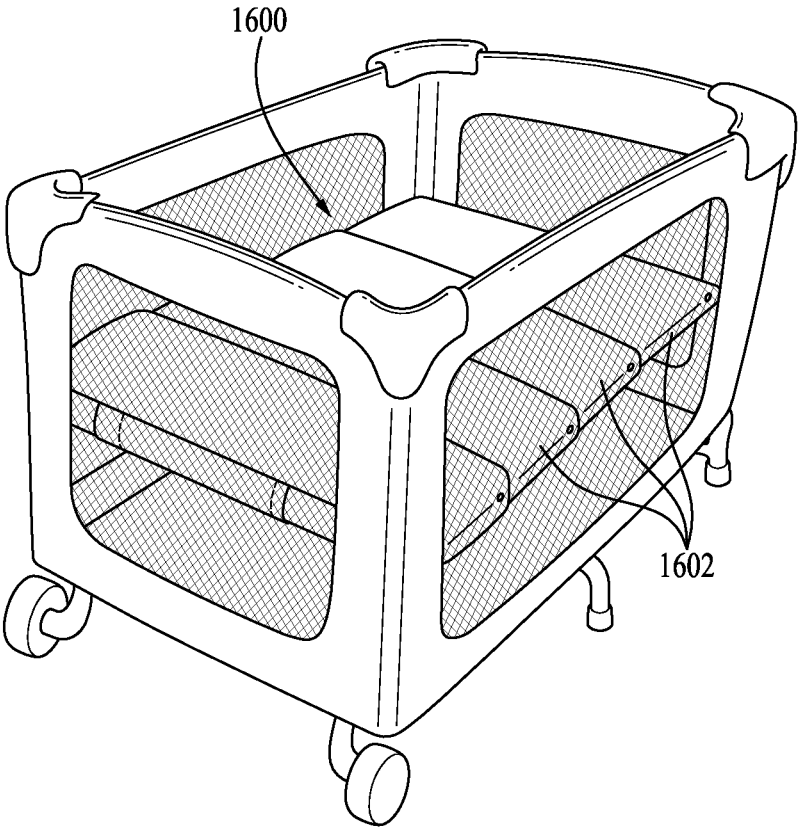
FIGS. 16A, 16B and 16C show a perspective view and side views showing a sequence of operation of a child containment apparatus having a bassinet mattress support assembly according to another example embodiment of the invention.
Figure 16B:
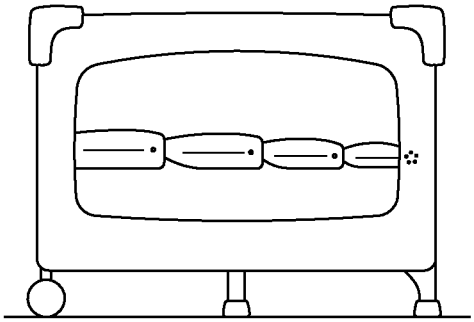
Figure 16C:
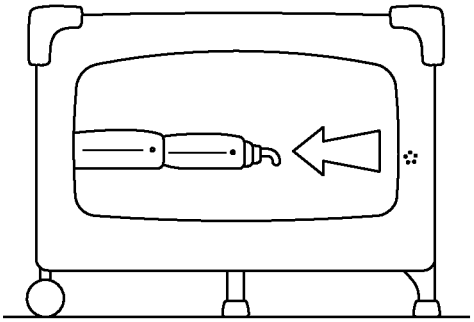

FIGS. 16A-16C illustrate another example embodiment of a mattress 1600, according to the present invention. The mattress 1600 comprises a plurality of substantially rigid, telescoping panels or boards 1602 and is convertible between an extended configuration, wherein the telescoping boards are slid out from one another, lengthening the mattress 1600, and a collapsed configuration, wherein the telescoping boards are slid or nested at least partially inside one another, shortening the mattress. In the extended position, the mattress 1600 can be positioned within a play yard, bassinet, or other child containment device and is configured to support a child.

Figure 17A:
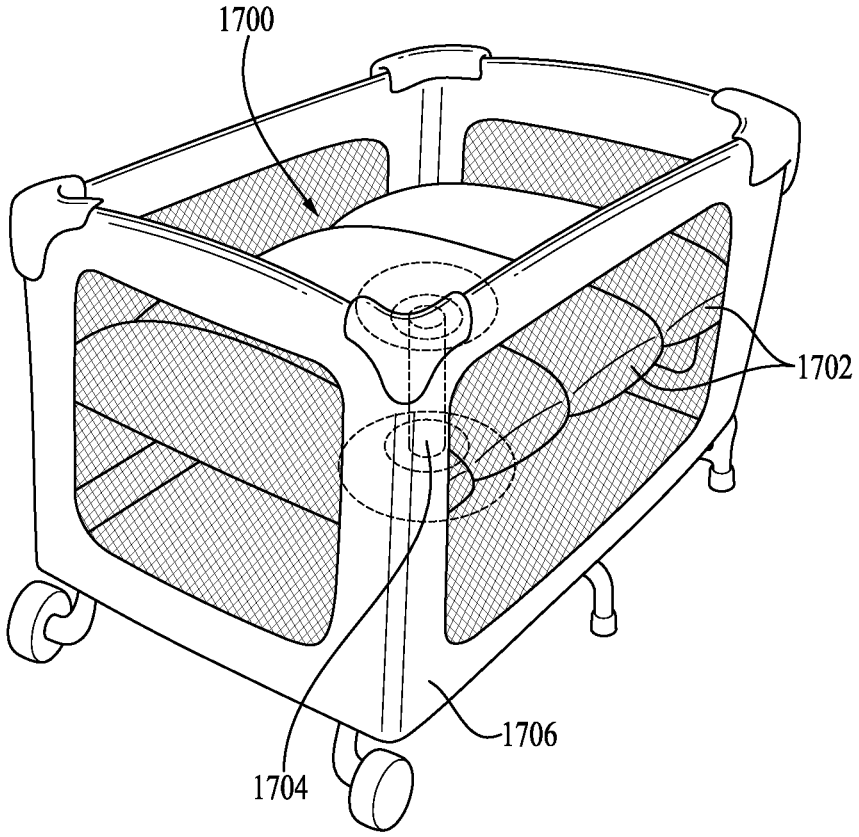
FIGS. 17A, 17B and 17C show a perspective view and side views showing a sequence of operation of a child containment apparatus having a bassinet mattress support assembly according to another example embodiment of the invention.
Figure 17B:
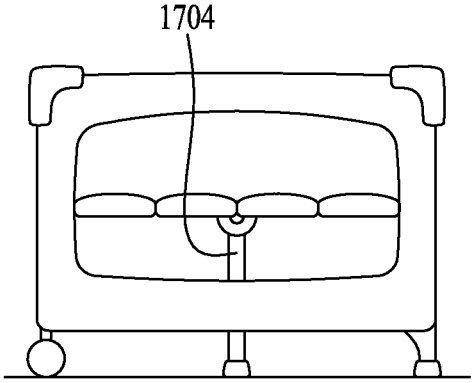
Figure 17C:
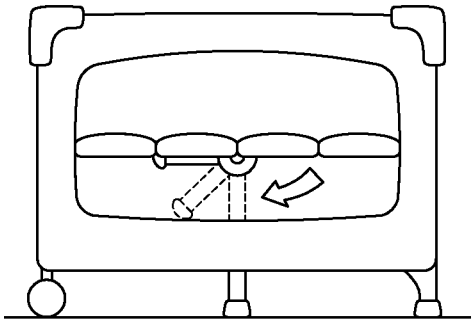
Figure 18A:
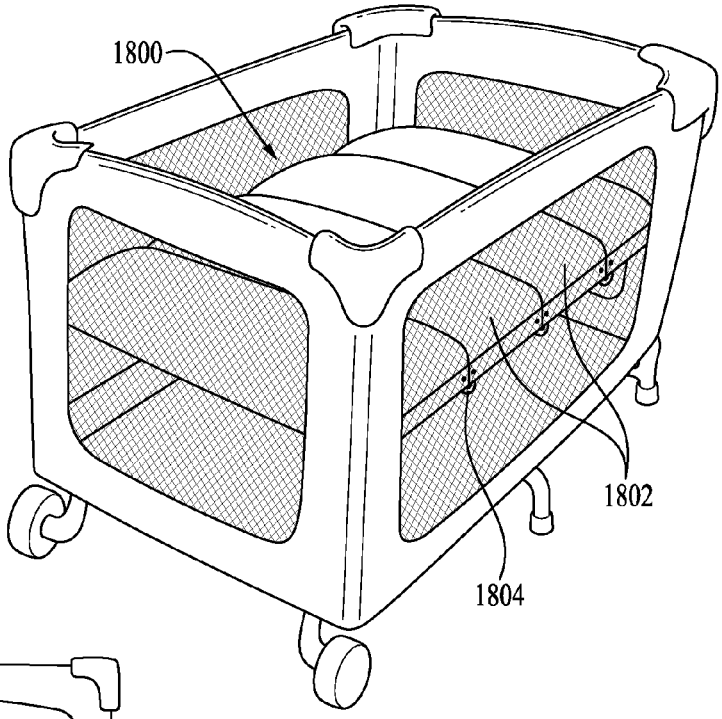
FIGS. 18A, 18B, 18C and 18D show perspective and side views showing a sequence of operation of a child containment apparatus having a bassinet mattress support assembly according to another example embodiment of the invention.
Figure 18B:
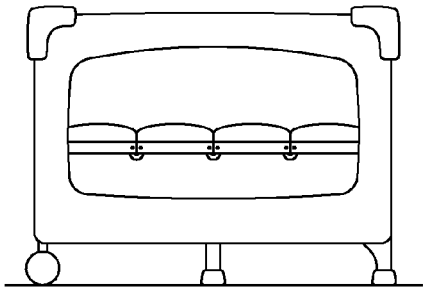
Figure 18C:
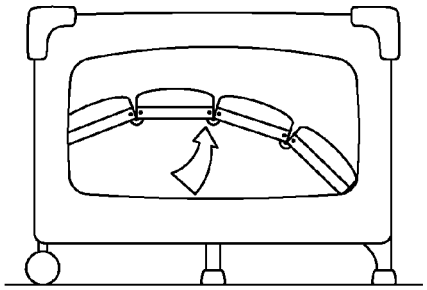
Figure 18D:
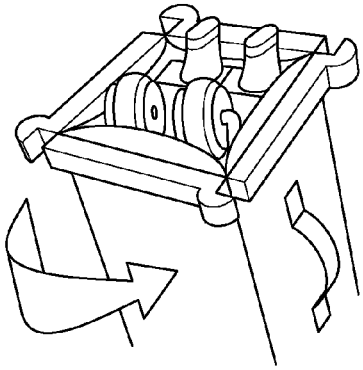
Figure 19A:
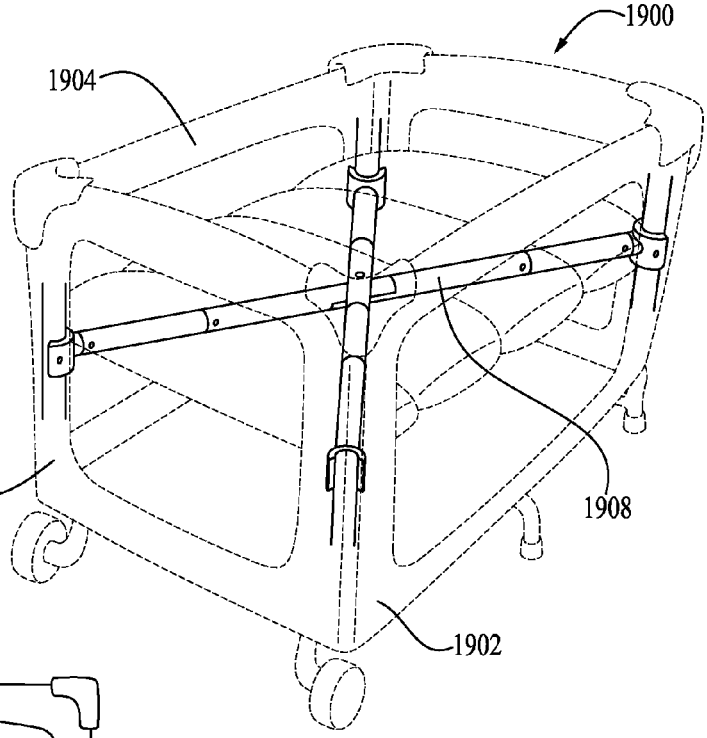
FIGS. 19A, 19B, 19C and 19D show perspective, side and partial detail views of a child containment apparatus having a bassinet mattress support assembly according to another example embodiment of the invention.
Figure 19B:
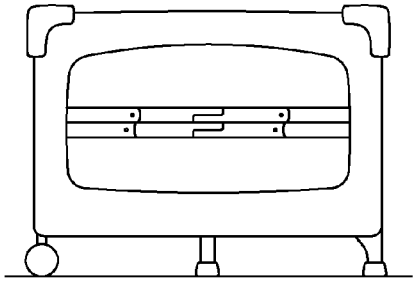
Figure 19D:
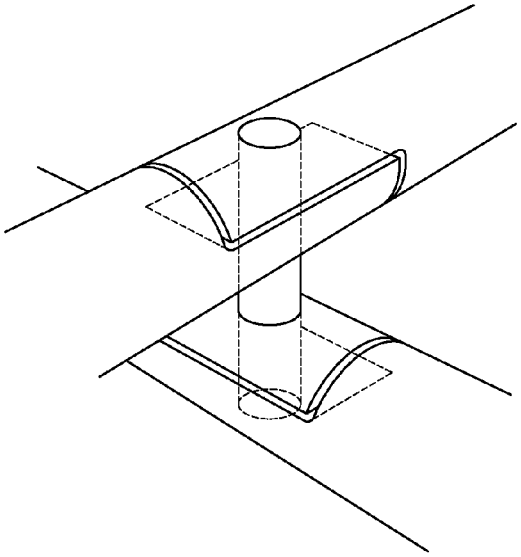
Figure 19C:
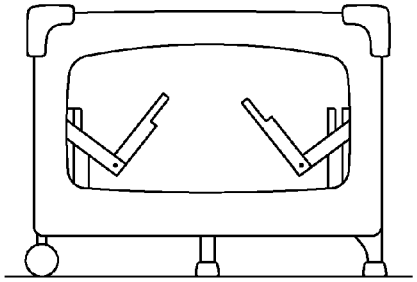

FIGS. 17A-17C illustrate another example embodiment of a mattress 1700, according to the present invention. The mattress 1700 comprises a plurality of substantially rigid panels or boards 1702 adapted to support a child. The mattress 1700 is configured to be positioned on the floor or other support surface of a suspended child support device within a child containment system such as a bassinet or play yard. One or more drop bars or support columns 1704 is/are configured to extend between the mattress 1700 and a support surface (e.g. the ground or the floor of a play yard 1706) to provide support to the suspended mattress. In the drawing figure, the lower end of the support column 1704 is configured to engage a portion of the play yard 1706, such as for example a bottom frame hub or other structural component of the play yard. In some example embodiments, the support column 1704 can be pivoted (or otherwise moved) to a collapsed configuration for easy storage or travel.

FIGS. 18A-18D illustrate another example embodiment of a mattress 1800, according to the present invention. The mattress 1800 comprises a plurality of substantially rigid panels or boards 1802 hingedly coupled to each other by one or more hinge mechanisms 1804, such that the mattress is convertible between an expanded configuration and a collapsed configuration. The mattress 1800 is preferably configured such that adjacent boards 1802 cannot rotate more than 180° with respect to one another. In the extended position, the mattress 1800 can be positioned within a play yard, bassinet, or other child containment device and is configured to support a child.

FIGS. 19A-19D show a play yard 1900 according to an example embodiment of the present invention. The play yard 1900 includes a lower frame 1902, upper frame 1904, and one or more support legs 1906 extending vertically between the lower and upper frames. One or more reinforcing rods 1908 are coupled to the support legs 1906 and extend generally horizontally and diagonally across the interior of the play yard 1900. The reinforcing rods 1908 are configured to support a bassinet floor and/or mattress (not shown) positioned within the play yard 1900. In some embodiments, the reinforcing rods 1908 are foldable to a collapsed configuration. One or more connection pins are optionally provided to connect the rods and/or forming pivot joints for extension and collapsibility of the support structure.

Figure 20A:
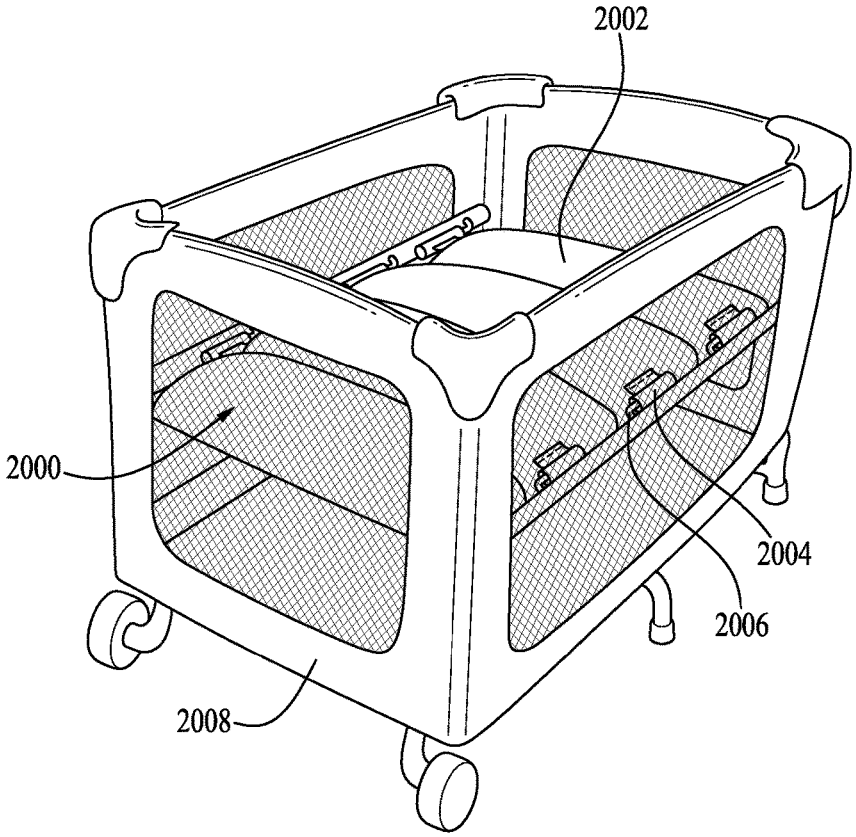
FIGS. 20A, 20B and 20C show a perspective view and side views showing a sequence of operation of a child containment apparatus having a bassinet mattress support assembly according to another example embodiment of the invention.
Figure 20B:
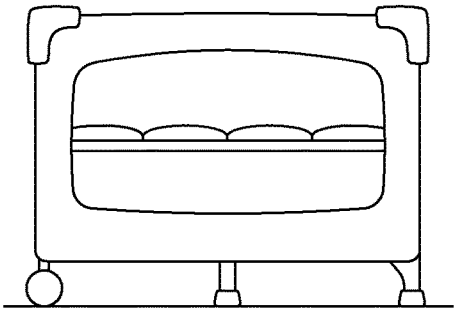
Figure 20C:
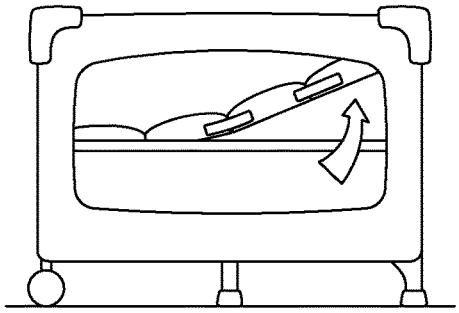

FIGS. 20A-20C illustrate an example embodiment of yet another mattress 2000, according to the present invention. The mattress 2000 comprises a plurality of substantially rigid panels or boards 2002 hingedly coupled to one another. One or more loops 2004 are attached around or along one or more sides of the perimeter edge of the mattress 2000 and are configured to removably receive one or more corresponding bars or hooks 2006 attached to a child support device, such as a bassinet or a play yard 2008, in order to secure the mattress to the child support device. In alternative embodiments, the loops 2004 are attached to the child support device and the hooks 2006 are attached to the mattress 2000.

Figure 21A:
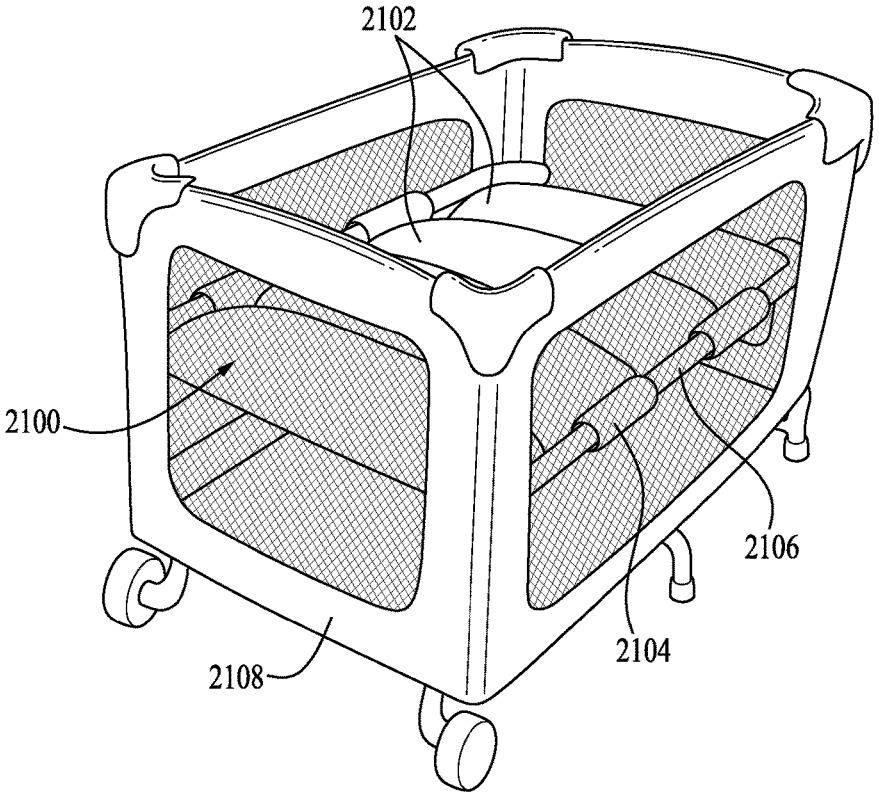
FIGS. 21A, 21B and 21C show a perspective view and side views showing a sequence of operation of a child containment apparatus having a bassinet mattress support assembly according to another example embodiment of the invention.
Figure 21B:
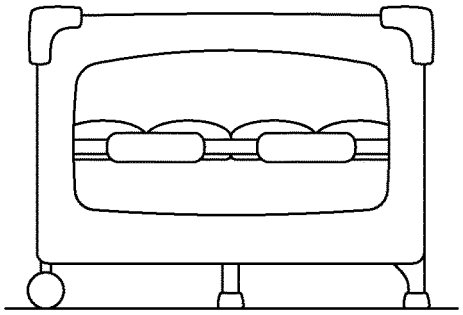
Figure 21C:
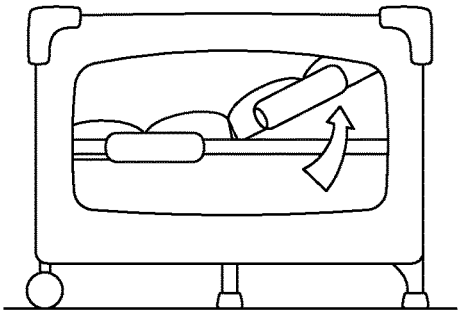

FIGS. 21A-21C illustrate an example embodiment of another mattress 2100, according to the present invention. The mattress 2100 comprises a plurality of substantially rigid panels or boards 2102 hingedly coupled to one another. One or more hooks 2104 are attached around or along one or more sides of the perimeter edge of the mattress 2100 and are configured to removably engage one or more support bars or rails 2106 attached to a child support device, such as a bassinet or a play yard 2108, in order to secure the mattress to the child support device. Alternatively, the hooks may be secured along the side(s) of the child support device and the rails secured along the edge(s) of the mattress. In still further alternative embodiments, the mattress includes loops configured to slide onto the rails.

Figure 22:
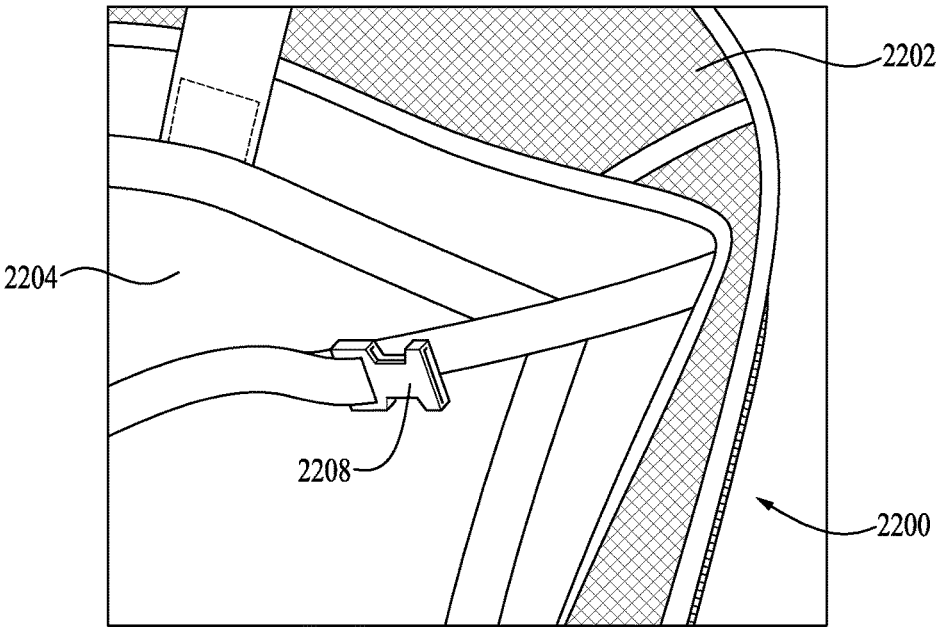
FIGS. 22 and 23 show perspective detail views of a child containment apparatus having a bassinet mattress support assembly according to another example embodiment of the invention.
Figure 23:
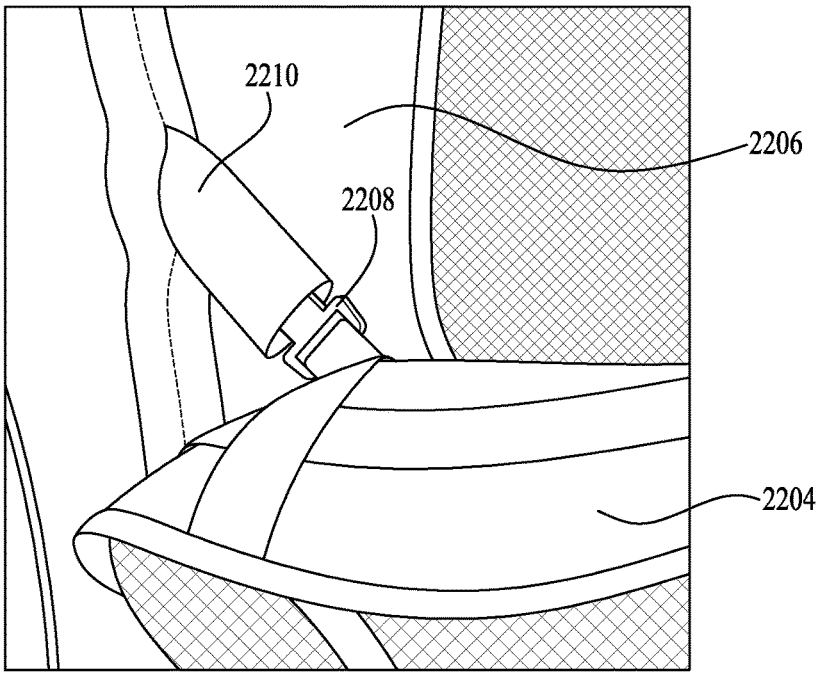

FIGS. 22 and 23 illustrate another bassinet 2200, according to an example embodiment of the present invention. The bassinet 2200 comprises a sidewall enclosure 2202 coupled to a floor panel 2204 and is configured to be suspended within a play yard 2206 to support a mattress or forming an integral mattress and support structure. At least one fastener 2208 is coupled to the underside of the floor panel 2204 and is configured to removably engage at least one corresponding mating fastener 2210 located on the play yard 2206. For example, the fastener 2208 can be a female buckle component and the mating fastener 2210 can be a male buckle component adapted to releasably engage the female buckle component. When the fastener 2208 and mating fastener 2210 are engaged, the floor panel 2204 is pulled substantially taut, minimizing or eliminating sagging of the floor panel. Optionally, straps to which the fasteners are affixed can provide length adjustment for tightening or loosening the floor panel. In example embodiments, a plurality of releasable interengaging cooperative fastener pairs are spaced about the periphery or about one or more side(s) of the play yard and the periphery or side(s) of the floor panel at corresponding locations. For example, two or more (four are depicted) fasteners may be provided along each side edge of the support panel. In alternate embodiments, the fasteners can comprise resilient snap couplings, buckles, clips, and the like.

Figure 24:
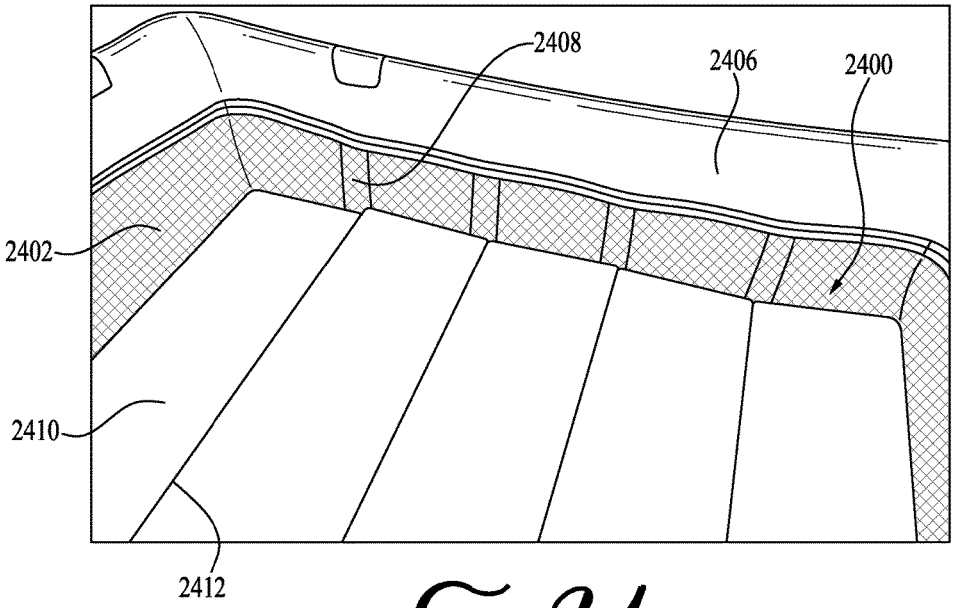
FIGS. 24, 25 and 26 show perspective and partial detail views of a child containment apparatus having a bassinet mattress support assembly according to another example embodiment of the invention.
Figure 25:
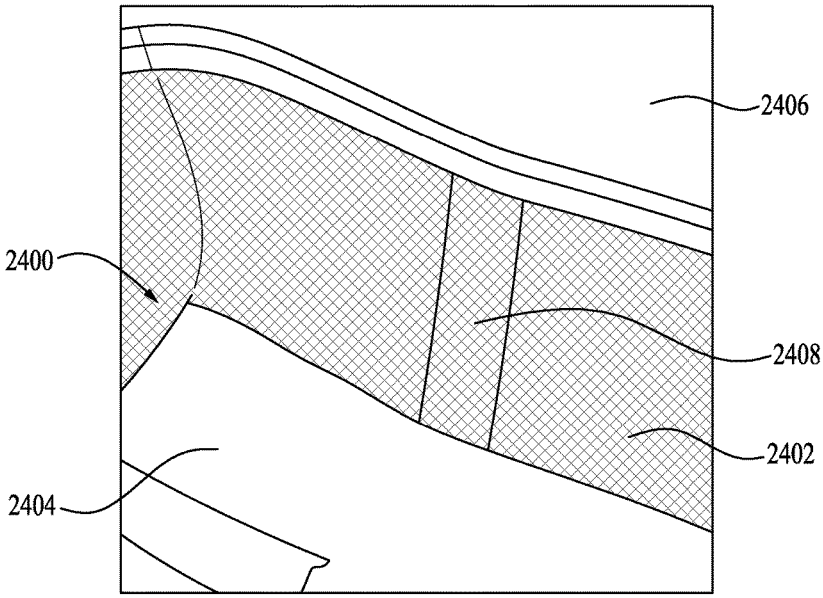
Figure 26:
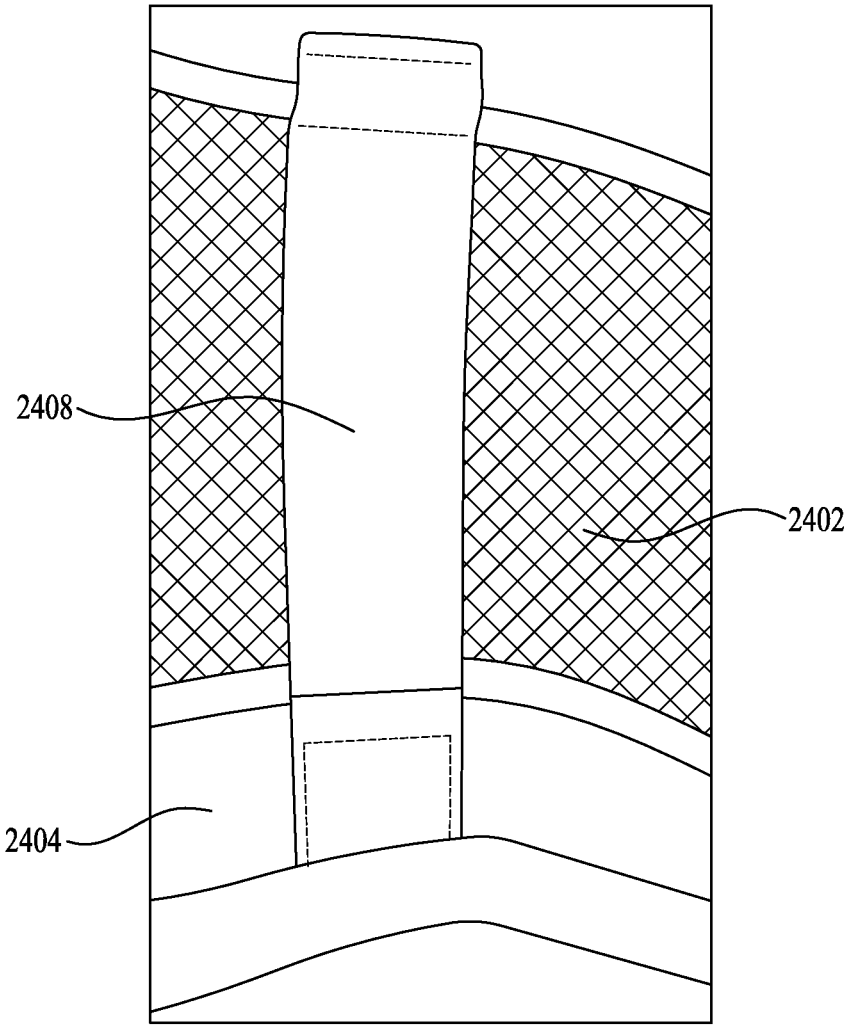

FIGS. 24, 25, and 26 illustrate another example embodiment of a bassinet 2400, according to the present invention. The bassinet 2400 comprises a sidewall enclosure 2402 coupled to a floor panel 2404 and is configured to be suspended within a play yard 2406. At least one reinforcing strap 2408 is coupled to the sidewall enclosure. Preferably, the reinforcing strap 2408 extends along the height of the sidewall enclosure 2402 substantially perpendicular to the floor panel 2404. In some example embodiments, the reinforcing strap 2408 terminates at or before the floor panel 2404. In other example embodiments, the reinforcing strap 2408 continues at least partially across the floor panel 2404, as shown in FIG. 26, optionally extending beneath and/or across the floor panel. A mattress 2410 adapted to support a child can be removably placed atop the floor panel 2404, or alternatively the floor panel can comprise an attached or integral mattress assembly. Example embodiments of mattress 2410 can be foldable, for example according to one or more example embodiments described herein, and the reinforcing straps 2408 can be positioned to align with and provide support to the fold lines 2412 of the mattress.

In further alternative embodiments of a bassinet according to the present invention, the bassinet comprises a sidewall enclosure coupled to a floor panel. One or more fasteners are secured to the floor panel and are configured to mate with one or more corresponding mating fasteners secured to a mattress when the mattress is positioned atop the floor panel. The fasteners and mating fasteners can be, for example, hook and loop fasteners, snaps, magnets, or another convention fastener. Alternatively, the floor panel and/or mattress can include rubber strips or other retention elements configured to prevent the mattress from sliding on the floor panel.

Figure 27:
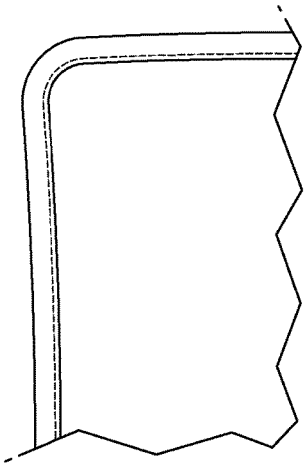
FIG. 27 PRIOR ART
FIGS. 27, 28 and 29 show partial detail views of a previously known bassinet mattress (FIG. 27) and an improved bassinet mattress (FIGS. 28 and 29) according to another example aspect of the invention.
Figure 28:
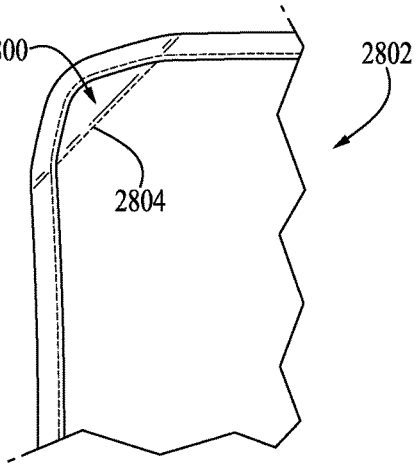
Figure 29:
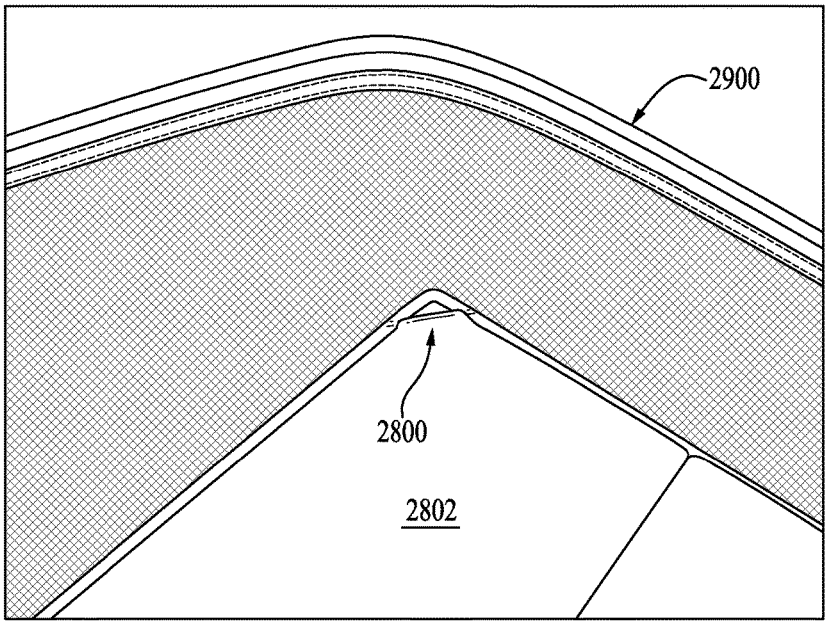

FIGS. 28 and 29 show a chamfered corner 2800 of a mattress panel 2802 according to another example aspect of the invention. In example embodiments, the corner 2800 comprises a living hinge, for example formed by stitching a seam between the mattress end and side, for example forming a foldable triangular tab at the corner of the mattress. When the mattress is installed into a play yard 2900, the chamfered corner 2800 folds at least partially upright to provide increased stiffening to resist rolling or curling of the end of the mattress, thereby maintaining a flatter mattress configuration than with a standard mattress corner as shown in FIG. 27. Cushioning or stiffening material within the mattress may be reduced or omitted at the fold line of the chamfered corner 2800, allowing the fabric or other outer shell material of the mattress 2802 to function as an integral hinge.

While the invention has been described with reference to preferred and example embodiments, it will be understood by those skilled in the art that a variety of modifications, additions and deletions are within the scope of the invention, as defined by the following claims.

What is claimed is:

1. A support structure for a mattress within a child containment device, the child containment device comprising at least one wall, the support structure comprising:

a support panel having a periphery configured to align with at least a portion of the at least one wall of the child containment device, the support panel comprising at least one retention pocket; and at least one retractable support member for engagement with the support panel to maintain the support panel in a generally flat configuration, the at least one retractable support member being selectively positionable in a functional configuration and a storage configuration, wherein the at least one retractable support member is oriented parallel to the support panel to reinforce the support panel in its functional configuration, and wherein the at least one retractable support member can be retained in the at least one retention pocket in its storage configuration;

wherein the at least one retractable support member can be retained in the at least one retention pocket in a position substantially perpendicular to the support panel in the storage configuration.

2. The support structure of claim 1, wherein the at least one retractable support member comprises at least one support bar.

3. The support structure of claim 1, wherein the at least one retractable support member comprises a sleeve and bar assembly.

4. The support structure of claim 1, further comprising a mattress for positioning over the support panel.

5. The support structure of claim 4, wherein the mattress is foldable.

6. The support structure of claim 1, wherein the at least one retractable support member is retractable into the at least one retention pocket.

7. The support structure of claim 1, wherein the at least one retractable support member comprises a first segment that is retractable into a second segment.

8. A support structure for a mattress within a child containment device, the child containment device comprising at least one wall, the support structure comprising:

a support panel having a periphery configured to align with at least a portion of the at least one wall of the child containment device, the support panel comprising first and second pairs of retention pockets at opposite sides of the support panel; and a pair of retractable support bars for engagement with the support panel to maintain the support panel in a generally flat configuration, each retractable support bar being selectively positionable in a functional configuration and a storage configuration, wherein each retractable support bar is oriented parallel to the support panel and configured to lie on top of the support panel with opposed end portions of each retractable support bar received in one of the first and second pairs of retention pockets to reinforce the support panel in its functional configuration, and wherein the end portion of the retractable support bars can be retained in the retention pockets in the storage configuration;

wherein each of the retractable support bars can be retained in a corresponding one of the retention pockets in a position substantially perpendicular to the support panel in the storage configuration.

9. The support structure of claim 8, wherein the retractable support bars each comprise a sleeve and bar assembly.

10. The support structure of claim 9, wherein the mattress is foldable.

11. The support structure of claim 8, further comprising a mattress for positioning over the support panel.

12. The support structure of claim 8, wherein the at least one retractable support member is retractable into the at least one retention pocket.

13. The support structure of claim 8, wherein the at least one retractable support member comprises a first segment that is retractable into a second segment.

14. A child containment device comprising:

at least one wall;

a support structure comprising:

a support panel having a periphery configured to align with at least a portion of the at least one wall of the child containment device, the support panel comprising at least one retention pocket; and at least one retractable support member for engagement with the support panel to maintain the support panel in a generally flat configuration, the at least one retractable support member being selectively positionable in a functional configuration and a storage configuration, wherein the at least one retractable support member is oriented parallel to the support panel to reinforce the support panel in its functional configuration, and wherein the at least one retractable support member can be retained in the retention pocket in its storage configuration; and a mattress positionable over the support panel and reinforced by the at least one retractable support member in its functional position;

wherein the at least one retractable support member can be retained in the at least one retention pocket in a position substantially perpendicular to the support panel in the storage configuration.

15. The child containment device of claim 14, wherein the at least one retractable support member comprises at least one support bar.

16. The child containment device of claim 14, wherein the at least one retractable support member comprises a sleeve and bar assembly.

17. The child containment device of claim 14, wherein the mattress is foldable.

18. The support structure of claim 14, wherein the at least one retractable support member is retractable into the at least one retention pocket.

19. The support structure of claim 14, wherein the at least one retractable support member comprises a first segment that is retractable into a second segment.

* * * * *